US009974368B1

(12) United States Patent
Moore

(10) Patent No.: US 9,974,368 B1
(45) Date of Patent: May 22, 2018

(54) CANE

(71) Applicant: John Moore, Old Bridge, NJ (US)

(72) Inventor: John Moore, Old Bridge, NJ (US)

( * ) Notice: Subject to any disclaimer, the term of this patent is extended or adjusted under 35 U.S.C. 154(b) by 0 days. days.

(21) Appl. No.: 15/428,547

(22) Filed: Feb. 9, 2017

Related U.S. Application Data

(60) Provisional application No. 62/293,869, filed on Feb. 11, 2016.

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/0288* (2013.01); *A45B 2200/055* (2013.01)

(58) Field of Classification Search
CPC ..... A61H 3/0288; A61H 3/0277; A45B 9/04; A45B 2200/055
USPC ..... 135/82, 84, 86
See application file for complete search history.

(56) References Cited

U.S. PATENT DOCUMENTS

| | | | | |
|---|---|---|---|---|
| 5,335,683 | A * | 8/1994 | Ledley | A45B 9/04 135/82 |
| 6,197,066 | B1 * | 3/2001 | Gabourie | A61F 2/66 623/52 |
| 6,514,293 | B1 * | 2/2003 | Jang | A61F 2/66 623/52 |
| 8,574,314 | B2 * | 11/2013 | Townsend | A61F 2/60 623/27 |
| 9,586,129 | B2 * | 3/2017 | Henrie | A63C 11/227 |
| 2006/0185703 | A1 * | 8/2006 | Townsend | A61H 3/02 135/82 |
| 2010/0206348 | A1 * | 8/2010 | Markou | A61H 3/02 135/71 |
| 2014/0332045 | A1 * | 11/2014 | Rudin | A45B 7/005 135/82 |
| 2016/0287464 | A1 * | 10/2016 | Younger | A45B 9/02 |

FOREIGN PATENT DOCUMENTS

| | | | | |
|---|---|---|---|---|
| DE | 102008004350 | A1 * | 7/2009 | A45B 3/00 |
| DE | 102008004350 | A1 * | 7/2009 | A45B 3/00 |

* cited by examiner

*Primary Examiner* — Noah Chandler Hawk
(74) *Attorney, Agent, or Firm* — Thomas M. Finetti; Charney IP Law LLC

(57) ABSTRACT

The present disclosure is directed to a cane end having attachment means and force absorbing means. In some embodiments, the force absorbing means is a blade capable of deflecting, compressing, and/or flexing under load.

11 Claims, 17 Drawing Sheets

CANE

CROSS-REFERENCE TO RELATED APPLICATIONS

The present application claims the benefit of the filing date of U.S. Provisional Patent Application 62/293,869 filed Feb. 11, 2016, the disclosure of which is hereby incorporated by reference herein in its entirety.

BACKGROUND OF THE DISCLOSURE

Walking canes are well known to those with ordinary skill in the art. Walking canes include a cane consisting of a single stick held in one hand and providing stability when the user places the distal end on the ground in the direction of travel so that the stick provides a third point of contact with the ground as the user moves. Modern walking canes can be more complex, with three or four legs on a foot assembly (U.S. Pat. No. 4,044,784); allow for an adjustment of staff length (U.S. Pat. No. 4,085,763); or telescoping canes for easy storage when not in use (U.S. Pat. No. 3,987,807).

Without wishing to be bound by any particular theory, it is believed that multiple-leg canes attempt to provide stabilization by providing more than one point of contact with the ground. With two or more contacts, the cane is believed to be less likely to twist or turn than when a single point of contact is maintained. However, the success of these canes is limited because the points of contact must change during the gait. For example, a four-legged cane usually has only two of its legs in contact with the ground for most of a user's gait; the back two legs of a four-legged cane touch the ground when the user extends it out to take a step. As the user's center of gravity reaches the cane's contact points, all four legs are on the ground, and then as the user passes the contact points and before the user pulls up the cane and places it forward again, only the front two legs of the cane remain in contact with the ground. This creates a multiple-stage use of the cane that is less graceful than the use of a standard one-legged cane.

Again, without wishing to be bound by any particular theory, another challenge for multiple-legged canes comes when the ground upon which the user is walking is uneven. If a user is walking on unimproved dirt or rock, a multi-leg cane may have only two or three legs touching the ground. Under such circumstances the user can be surprised by the lack of contact of one leg that creates in an unexpected lack of support and result with the user falling.

BRIEF SUMMARY OF THE DISCLOSURE

In one aspect of the present disclosure is a cane end comprising a monolithic body, the monolithic body capable of being deflected, compressed, and/or flexed (used collectedly and/or interchangeably herein), wherein the monolithic body comprises an upper portion and a lower portion, wherein the upper portion comprises at least one engagement member for releasably engaging a shaft of a cane and an optional catch member; and wherein the lower portion comprises a circular shape having variable radius of curvature. In some embodiments, the cane end is able to withstand a load of at least 30 pounds. In some embodiments, the cane end is able to withstand a load of at least 40 pounds. In some embodiments, the cane end is able to withstand a load of at least 50 pounds. In some embodiments, the cane end is able to withstand a load of at least 60 pounds. In some embodiments, the cane end is able to withstand a load of at least 70 pounds. In some embodiments, the cane end is able to withstand a load of at least 80 pounds. In some embodiments, the cane end is able to withstand a load of at least 90 pounds. In some embodiments, the cane end is able to withstand a load of at least 100 pounds. In some embodiments, the cane end is able to withstand a load of at least 120 pounds. In some embodiments, the cane end is able to withstand a load of at least 150 pounds.

In some embodiments, the lower portion of the cane end has an undeflected, uncompressed and/or unflexed conformation which is substantially a mirror image of an "c" shape. In these embodiments, the lower portion and the upper portion are integral.

In some embodiments, the cane end has an undeflected, uncompressed and/or unflexed conformation which is substantially a "s" shape. In these embodiments, the cane end comprises integral lower and power portions and further comprises a middle portion continuous with both the upper and lower portions. In some embodiments, when the cane is in an uncompressed and/or unflexed conformation, the middle portion is substantially parallel to the ground.

In some embodiments, the cane end has an undeflected, uncompressed and/or unflexed conformation which is substantially a mirror image of an "e" shape. In some embodiments, the upper portion has a uniform thickness. In some embodiments, the upper portion tapers from a first thickness to a second thickness. In some embodiments, the lower portion has a uniform thickness. In some embodiments, the uniform thickness of the lower portion and the second thickness of the upper portion are the same. In some embodiments, the cane end compresses and/or flexes under load such that an open end of the lower portion contacts the catch member of the upper portion. In some embodiments, the upper portion comprises a top member and a bottom member, wherein the top and bottom members are continuous. In some embodiments, the top member comprises an opening to accept the shaft of the cane. In some embodiments, the top member comprises a first engagement member and wherein the bottom member comprises a second engagement member (e.g. a frictional engagement member). In some embodiments, the first and second engagement members are vertically aligned. In some embodiments, a contact point with the ground on the lower portion is offset from a point of vertical loading on the upper portion. In some embodiments, the cane end compresses and/or flexes from a substantially circular shape to an ovoid shape.

In some embodiments, at least a portion of an outer surface of the lower portion comprises one or more traction members. In some embodiments, at least 10% of the outer surface comprises traction members. In some embodiments, at least 15% of the outer surface comprises traction members. In some embodiments, at least 20% of the outer surface comprises traction members. In some embodiments, at least 25% of the outer surface comprises traction members. In some embodiments, at least 30% of the outer surface comprises traction members. In some embodiments, at least 40% of the outer surface comprises traction members. In some embodiments, at least 50% of the outer surface comprises traction members. In some embodiments, at least 60% of the outer surface comprises traction members. In some embodiments, at least 70% of the outer surface comprises traction members. In some embodiments, the one or more traction members comprise wear indicators. In some embodiments, the one or more traction members are replaceable. In some embodiments, the one or more traction members comprise a material selected from the group consisting of natural or synthetic rubbers, silicones, and any combination thereof.

In some embodiments, at least a portion of an outer surface of lower portion comprises a material which is different than the material of the lower portion. In some embodiments, the different material is mounted on the outer surface of the lower portion. In some embodiments, the different material is coated on the outer surface of the lower portion.

In some embodiments, the cane end further comprises one or more sensors. In some embodiments, the sensors are selected from the group consisting of pressure sensors and accelerometers.

In another aspect of the present disclosure is a cane end comprising a monolithic, compressible and/or body, the monolithic compressible body comprising a lower portion having a continuously convexly curved surface and having a variable radius of curvature; and an upper portion continuous with the lower portion, the upper portion having a continuously curved surface which at least partially extends into a cavity defined by the lower and upper portions, the upper portion further comprising at least one engagement member for releasably engaging a shaft of a cane. In some embodiments, the cane end has an uncompressed and/or unflexed conformation which is substantially a mirror image of an "e" shape.

In another aspect of the present disclosure is a cane end comprising a monolithic body, the monolithic body constructed from a polymeric material, and wherein the monolithic body has a conformation substantially resembling an "e" shape when no load is supplied to the monolithic body, and wherein upon application of a load the monolithic body deflects, compresses, and/or flexes from the conformation substantially resembling the "e" shape to a conformation that is substantially ovoid, and wherein the monolithic body is capable of supporting a load of at least 30 pounds. In some embodiments, the monolithic body comprises force absorption means. In some embodiments, the monolithic body comprises a blade. In some embodiments, the monolithic body comprises an upper portion and a lower portion. In some embodiments, the lower portion comprises a blade. In some embodiments, the lower portion comprises a curvilinear or arcuate portion. In some embodiments, the upper portion tapers from a first thickness to a second thickness. In some embodiments, the lower portion has a uniform thickness. In some embodiments, at least a portion of an outer surface of the lower portion comprises one or more traction members. In some embodiments, the cane end deflects under load such that an open end of the lower portion contacts the catch member of the upper portion. In some embodiments, the upper portion comprises a top member and a bottom member, the top and bottom members are continuous. In some embodiments, the top member comprises a first engagement member and wherein the bottom member comprises a second engagement member. In some embodiments, the first and second engagement members are vertically aligned. In some embodiments, a contact point with the ground on the lower portion is offset from a point of vertical loading on the upper portion.

DETAILED DESCRIPTION

Figure 1A:
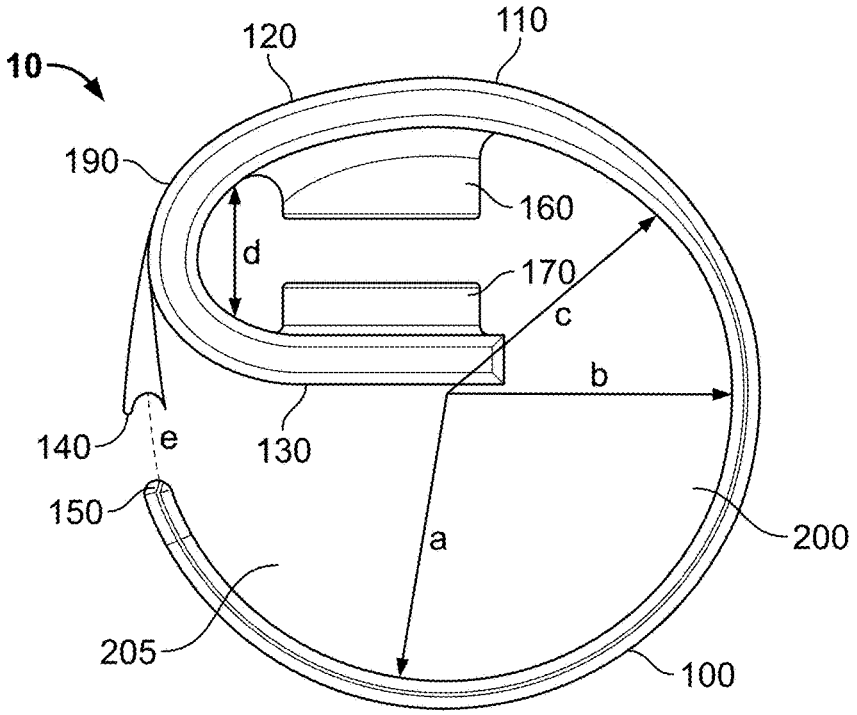
FIG. 1A illustrates a cross-sectional view of a cane end according to one embodiment of the present disclosure.

As used herein, the singular terms "a," "an," and "the" include plural referents unless context clearly indicates otherwise. Similarly, the word "or" is intended to include "and" unless the context clearly indicates otherwise. The term "includes" is defined inclusively, such that "includes A or B" means including A, B, or A and B.

The terms "comprising," "including," "having," and the like are used interchangeably and have the same meaning. Similarly, "comprises," "includes," "has," and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c. Moreover, while the steps and processes may be outlined herein in a particular order, the skilled artisan will recognize that the ordering steps and processes may vary.

In general, the present disclosure is directed to a cane end having attachment means and force absorbing means. In some embodiments, the cane end is capable of sustaining, absorbing, and/or releasing a load of between 20 and 250 pounds. In some embodiments, the force absorbing means is capable of sustaining a load up to about 250 pounds. In some embodiments, the cane end is able to withstand a load of at least 30 pounds. In some embodiments, the cane end is able to withstand a load of at least 40 pounds. In some embodiments, the cane end is able to withstand a load of at least 50 pounds. In some embodiments, the cane end is able to withstand a load of at least 60 pounds. In some embodiments, the cane end is able to withstand a load of at least 70 pounds. In some embodiments, the cane end is able to withstand a load of at least 80 pounds. In some embodiments, the cane end is able to withstand a load of at least 90 pounds. In some embodiments, the cane end is able to withstand a load of at least 100 pounds. In some embodiments, the cane end is able to withstand a load of at least 120 pounds. In some embodiments, the cane end is able to withstand a load of at least 150 pounds.

In some embodiments, the attachment means allows for the releasable engagement of a cane shaft or other structure to the cane end. In some embodiment, the attachment means facilitates a frictional engagement between a cane shaft and the cane end.

In some embodiments, the entirety of a body of the cane end acts as the force absorbing means. In some embodiments, the force absorbing means is a monolithic blade. In other embodiments, the force absorbing means is a monolithic blade and wherein the attachment means is secured to an upper portion of the monolithic blade (i.e. a portion that is not designed to contact the ground, e.g. a portion that is opposite a portion that contacts the ground). In some embodiments, the force absorbing means is a blade capable of deflecting, compressing, and/or flexing under load. In some embodiments, the force absorbing means is a blade that is not permanently deformable. In some embodiments, the force absorbing means comprises a curvilinear portion or an arcuate portion capable of deflecting, compressing, and/or flexing under load. In some embodiments, the force absorbing means has a point of contact with the ground that is offset from a point of vertical loading. In some embodiments, the force absorbing means comprises an exterior surface having means for increasing grip or traction between a surface (e.g. the ground) and the cane end.

In some embodiments, the unloaded force absorbing means comprises a point of contact having an initial surface area of at least 1.5 square inches. In other embodiments, the unloaded force absorbing means comprises a point of contact having an initial surface area of at least 2 square inches.

In some embodiments, a height of a cane end may range from between about 1 inch to about 7 inches. In other embodiments, a height of a cane end may range from between about 1 inch to about 6 inches. In some embodiments, a height of a cane end may range from between about 1 inch to about 6.5 inches. In some embodiments, a height of a cane end may range from between about 1 inch to about 6 inches. In some embodiments, a height of a cane end may range from between about 1 inch to about 5.5 inches. In some embodiments, a height of a cane end may range from between about 1 inch to about 5 inches. In some embodiments, a height of a cane end may range from between about 1 inch to about 4.5 inches. In some embodiments, a height of a cane end may range from between about 1.5 inch to about 5.5 inches. In some embodiments, a height of a cane end may range from between about 1.5 inch to about 5 inches. In some embodiments, a height of a cane end may range from between about 1.5 inch to about 4.5 inches. In some embodiments, a height of a cane end may range from between about 1.5 inch to about 4 inches. In some embodiments, a height of a cane end may range from between about 1 inch to about 3.75 inches. In some embodiments, a height of a cane end may range from between about 1 inch to about 3.5 inches.

In some embodiments, a width of a cane end may range from between about 1 inch to about 7 inches. In other embodiments, a width of a cane end may range from between about 1 inch to about 6 inches. In some embodiments, a width of a cane end may range from between about 1 inch to about 6.5 inches. In some embodiments, a width of a cane end may range from between about 1 inch to about 6 inches. In some embodiments, a width of a cane end may range from between about 1 inch to about 5.5 inches. In some embodiments, a width of a cane end may range from between about 1 inch to about 5 inches. In some embodiments, a width of a cane end may range from between about 1 inch to about 4.5 inches. In some embodiments, a width of a cane end may range from between about 1.5 inch to about 5.5 inches. In some embodiments, a width of a cane end may range from between about 1.5 inch to about 5 inches. In some embodiments, a width of a cane end may range from between about 1.5 inch to about 4.5 inches. In some embodiments, a width of a cane end may range from between about 1.5 inch to about 4 inches. In some embodiments, a width of a cane end may range from between about 1 inch to about 3.75 inches. In some embodiments, a width of a cane end may range from between about 1 inch to about 3.5 inches.

In some embodiments, a depth of the cane end may range from between 0.3 inches to about 3 inches. In some embodiments, a depth of the cane end may range from between 0.3 inches to about 2.75 inches. In some embodiments, a depth of the cane end may range from between 0.3 inches to about 2.5 inches. In some embodiments, a depth of the cane end may range from between 0.3 inches to about 2.25 inches. In some embodiments, a depth of the cane end may range from between 0.3 inches to about 2 inches. In some embodiments, a depth of the cane end may range from between 0.3 inches to about 1.8 inches. In some embodiments, a depth of the cane end may range from between 0.3 inches to about 1.6 inches. In some embodiments, a depth of the cane end may range from between 0.3 inches to about 1.5 inches. In some embodiments, a depth of the cane end may range from between 0.3 inches to about 1.4 inches. In some embodiments, a depth of the cane end may range from between 0.3 inches to about 1.3 inches. In some embodiments, a depth of the cane end may range from between 0.3 inches to about 1.2 inches. In some embodiments, a depth of the cane end may range from between 0.3 inches to about 1.1 inches. In some embodiments, a depth of the cane end may range from between 0.3 inches to about 1 inch. In some embodiments, a depth of the cane end may range from between 0.5 inches to about 1 inch. In some embodiments, a depth of the cane end may range from between 0.75 inches to about 1 inch. In some embodiments, a depth of the cane end may range from between 0.3 inches to about 0.7 inches. In some embodiments, a depth of the cane end may range from between 0.5 inches to about 1 inch. In some embodiments, a depth of the cane end may range from between 0.5 inches to about 1.1 inches. In some embodiments, a depth of the cane end may range from between 0.5 inches to about 1.2 inches. In some embodiments, a depth of the cane end may range from between 0.5 inches to about 1.3 inches. In some embodiments, a depth of the cane end may range from between 0.5 inches to about 1.4 inches. In some embodiments, a depth of the cane end may range from between 0.5 inches to about 1.5 inches. In some embodiments, a depth of the cane end may range from between 0.5 inches to about 1.6 inches. In some embodiments, a depth of the cane end may range from between 0.5 inches to about 1.7 inches. In some embodiments, a depth of the cane end may range from between 0.5 inches to about 1.8 inches. In some embodiments, a depth of the cane end may range from between 0.5 inches to about 1.9 inches. In some embodiments, a depth of the cane end may range from between 0.5 inches to about 2 inches.

In some aspects of the present disclosure, the cane end comprises a body having a curved blade, a portion of which is designed to contact the ground. In some embodiments, at least a portion of the blade has an arcuate shape. In some embodiments, at least a portion of the blade has a continuously convexly curved surface. In some embodiments, the continuously convexly curved surface at least partially curves back over itself forming an opening or lumen. In some embodiments, the continuously convexly curved surface at least partially curves back over itself at least once. In some embodiments, the continuously convexly curved surface curves back over itself twice, e.g. forming a "s" like shape or the mirror image of an "e" like shape. In some embodiments, the curved blade is designed to deflect, compress and/or flex when a force is applied or transmitted to it. As such, the skilled artisan will appreciate that the curved blade is capable of absorbing forces applied to it when under a load. Likewise, the skilled artisan will appreciate that the curved blade will substantially return to its non-deflected, uncompressed or unflexed conformation after the load is removed. The skilled artisan will also appreciate that, in some embodiments, the cane end is comprised of a material that will not permanently deform when a load is applied. In some embodiments, the blade may have an exterior surface that comprises means for increasing grip or traction between a surface (e.g. the ground) and the cane end. In some embodiments, the blade comprises means for attachment to a shaft of a cane, a pole, or other rigid or semi-rigid structures. A cane shaft for use with the cane end described herein may be constructed from any of a variety of materials, including aluminum, anodized aluminum, metal, stainless steel, plastic, composite materials, and fiberglass. In some embodiments, the cane end is capable of sustaining a load of between 20 and 250 pounds. In some embodiments, the cane end is capable of deflecting between about 0.3 inches to about 3 inches when under load. In some embodiments, the cane end is capable of deflecting between about 0.3 inches to about 2.5 inches when under load. In some embodiments, a point of contact of the unloaded blade and a surface (e.g. a substrate or ground) has an initial surface area of at least 1.5 square inches. In other embodiments, a point of contact of the unloaded blade and a surface (e.g. a substrate or ground) has an initial surface area of at least 2 square inches In some aspects of the present disclosure, the cane end comprises a body having a curvilinear or arcuate portion that at least partially contacts the ground. In some embodiments, and as will be described further herein, the curvilinear or arcuate portion may contact the ground and deflect, flex and/or compress under load. In some embodiments, the curvilinear or arcuate portion of the cane end is continuous with an upper portion of the cane end. In some embodiments, the upper portion is also at least partially curvilinear or arcuate in shape. In some embodiments, the cane end may comprise a portion having a conformation that resembles or substantially resembles a mirror image of a "c" shape. In some embodiments, the cane end may have a conformation that resembles or substantially resembles an "e" shape. In some embodiments, the cane end may have a conformation that resembles or substantially resembles a mirror image of an "e" shape. In some embodiments, the cane end may have a conformation that resembles or substantially resembles a "s" shape. In some embodiments, the cane end may comprise a first conformation when not under load (herein after the "unloaded" conformation) and a second conformation when under load (herein after the "loaded" conformation). As the skilled artisan will appreciate, there may exist a continuum of intermediary conformations between the unloaded and loaded conformations, and these various conformations may depend on the stress loads (and types of stress loads) placed on or transmitted to the cane end, the unloaded shape of the cane end, the materials constituting the cane end, the thickness of the components of the cane end, and/or the manufacturing process used to make the cane end (e.g. monolithic vs. multiple components secured together). The skilled artisan will also appreciate that not all loads placed on the cane end may be in a direction perpendicular to the ground. Indeed, it is contemplated that loads may be placed on the cane end or transmitted to the cane end at an angle relative to the ground and, as a result, there may exist conformations that comprise a twist or bend. In some embodiments, the cane end is monolithic. In other embodiments, the cane end is comprised of multiple pieces which are fastened or otherwise secured together by any means.

Figure 1B:
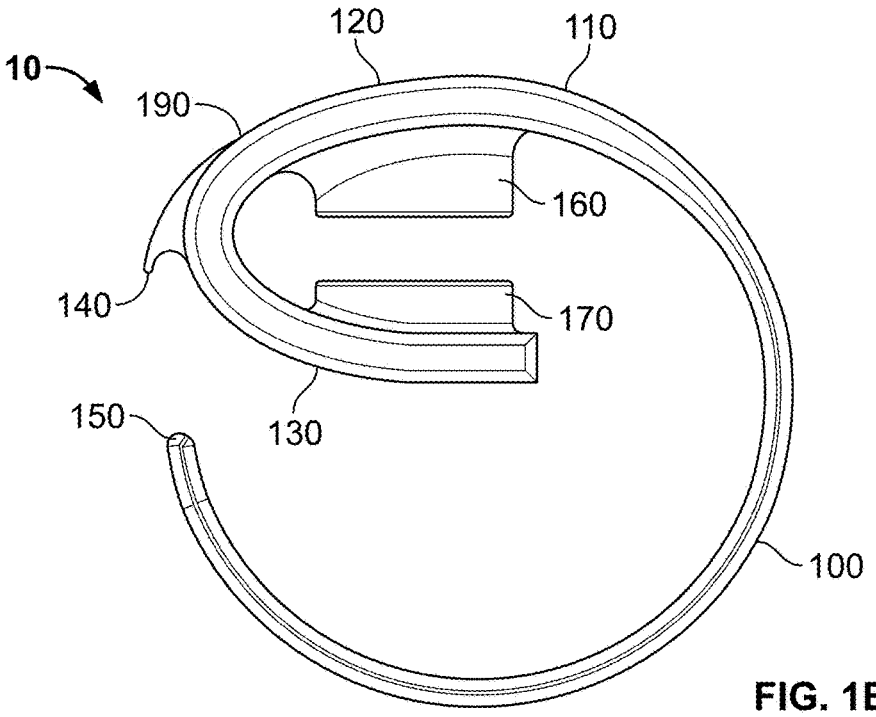
FIG. 1B illustrates a side view of a cane end according to one embodiment of the present disclosure, the cane end having a conformation resembling a mirror image of an "e" shape.
Figure 1C:
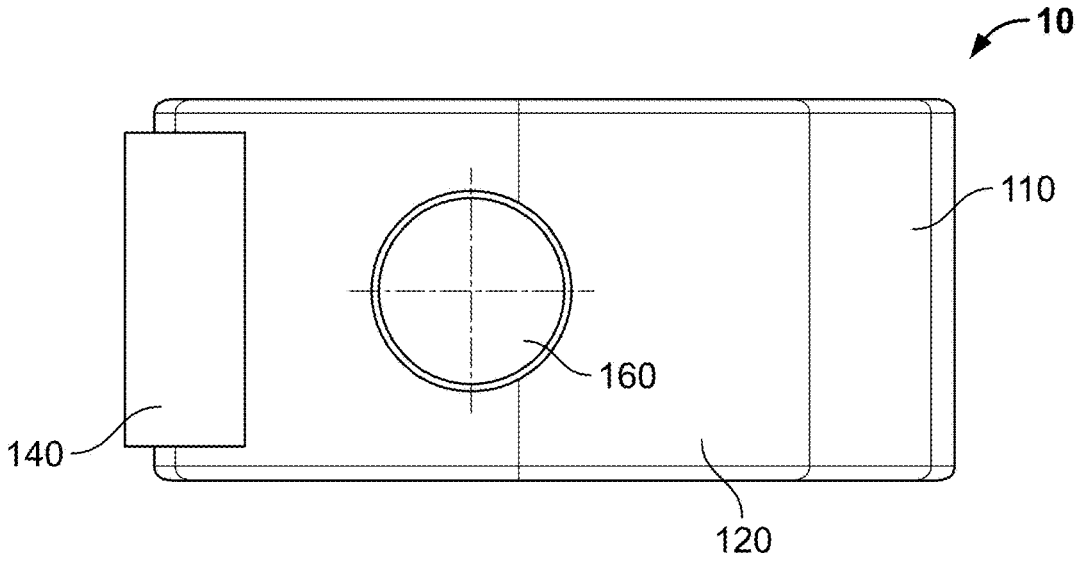
FIG. 1C illustrates a top view of a cane end having a conformation resembling a mirror image of an "e" shape, whereby a first engagement member in an upper portion of the cane end is visible.
Figure 1D:
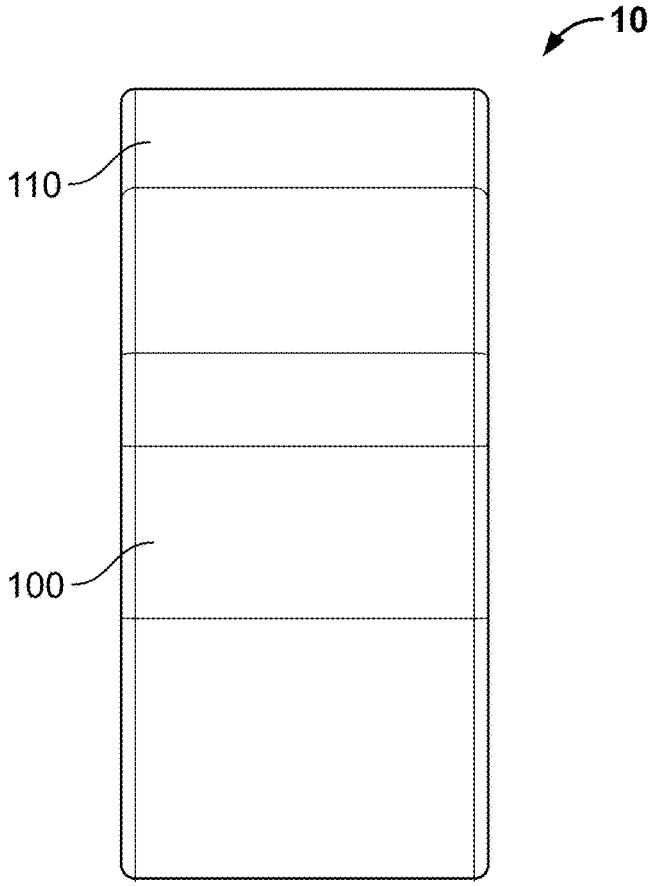
FIG. 1D illustrates a front view of a cane end having a conformation resembling a mirror image of an "e" shape, whereby the lower portion of the cane end is visible.
Figure 1E:
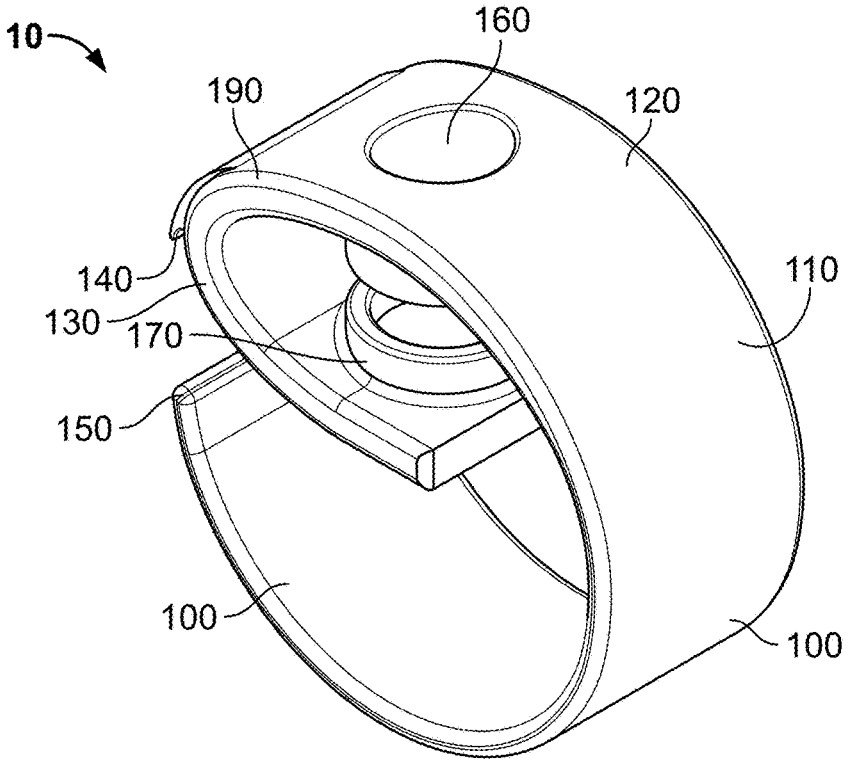
FIG. 1E illustrates a perspective view of a cane end having a conformation resembling a mirror image of an "e" shape.

FIGS. 1A, 1B, 1D, and 1D illustrates one embodiment of a cane end 10 of the present disclosure. In some embodiments, the cane end 10 of FIGS. 1A and 1B have a conformation that resembles or substantially resembles an "e" shape or a mirror image of an "e" shape when the cane end is not under a load. In some embodiments, a lower portion 100 is continuous with an upper portion 110. In some embodiments, at least a portion of the lower portion 100 has a continuously convexly curved surface. In some embodiments, the lower portion 100 may comprise a variable radius of curvature. The skilled artisan will appreciate that, given the curvilinear or arcuate shape of the lower portion 100, at least a portion of it will contact a surface (e.g. the ground). In some embodiments, any radius may range from about 0.5 inches to about 5 inches. In other embodiments, any radius may range from about 0.5 inches to about 4 inches. In other embodiments, any radius may range from about 0.5 inches to about 3 inches. In other embodiments, any radius may range from about 0.5 inches to about 4 inches. In other embodiments, any radius may range from about 1 inches to about 3 inches. In other embodiments, any radius may range from about 1 inches to about 2.75 inches. In other embodiments, any radius may range from about 0.75 inches to about 2.5 inches. In other embodiments, any radius may range from about 0.75 inches to about 1.75 inches. In other embodiments, any radius may range from about 1 inches to about 1.75 inches.

Figure 2A:
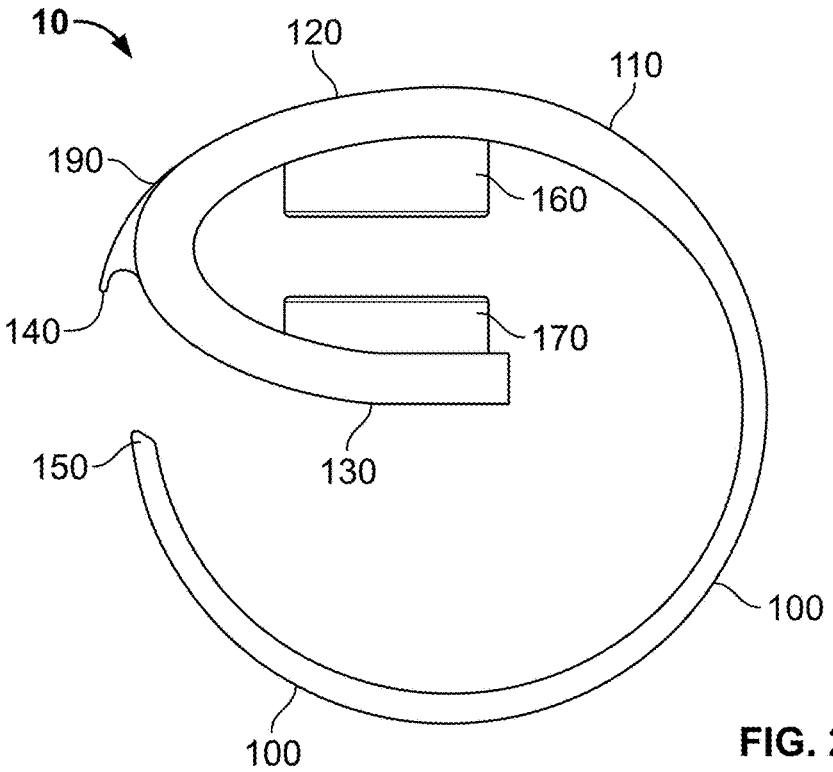
FIG. 2A illustrates a side view of a cane end according to an alternative embodiment of the present disclosure, the cane end having a conformation resembling a mirror image of an "e" shape in an unloaded conformation.
Figure 2B:
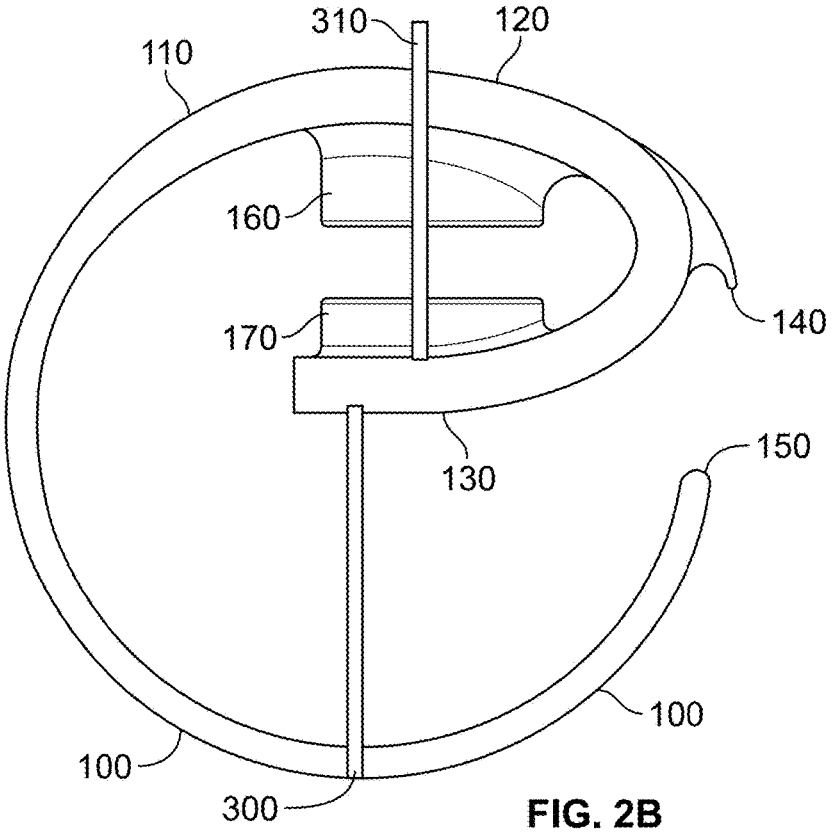
FIG. 2B illustrates the point of vertical loading as compared with the point of contact with a surface for a cane end having a conformation resembling a mirror image of an "e" shape in an unloaded conformation.
Figure 6:
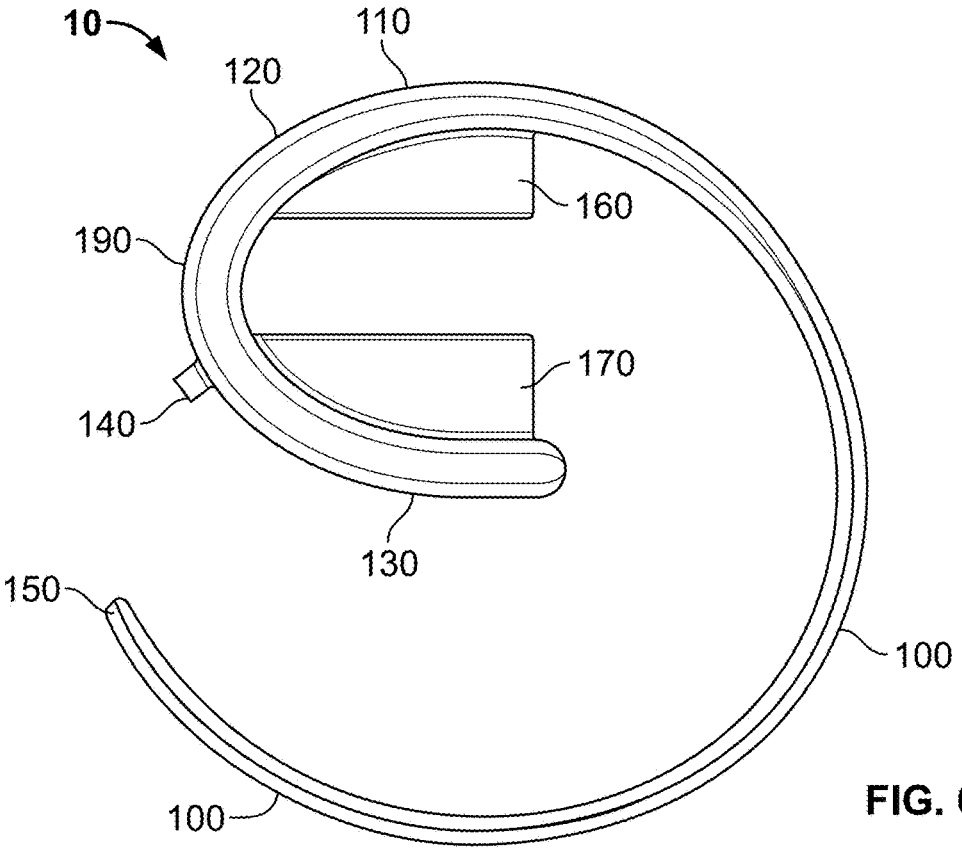
FIG. 6 sets forth a side view of an alternative cane end having a conformation resembling a mirror image of an "e" shape in an unloaded conformation.
Figure 8:
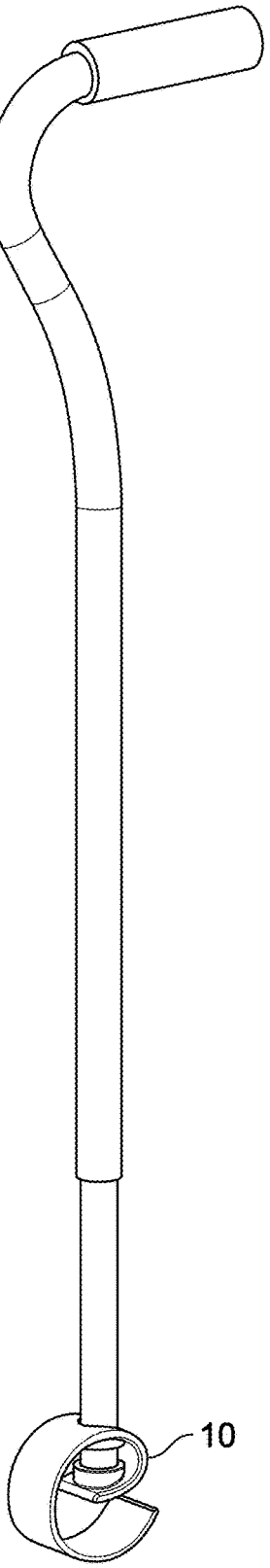
FIG. 8 sets forth a cane end resembling a mirror image of an "e" shape in an unloaded conformation, where the cane end is releasably engaged to the shaft of a cane.
Figure 9A:
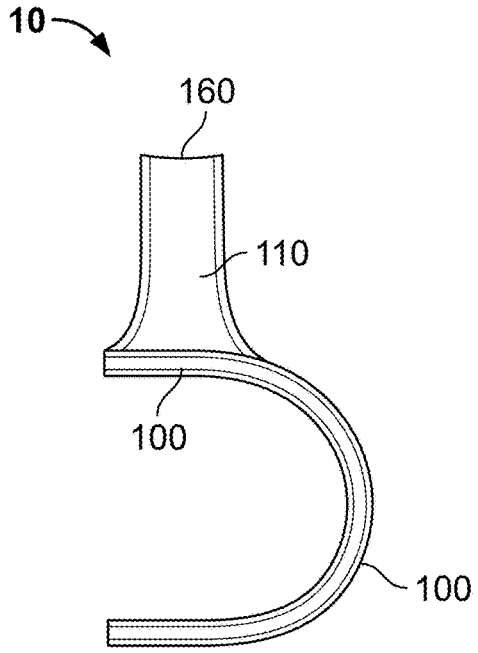
FIG. 9A provides a cross-sectional view of a cane end having a conformation resembling a mirror image of a "c" shape in an unloaded conformation.
Figure 9B:
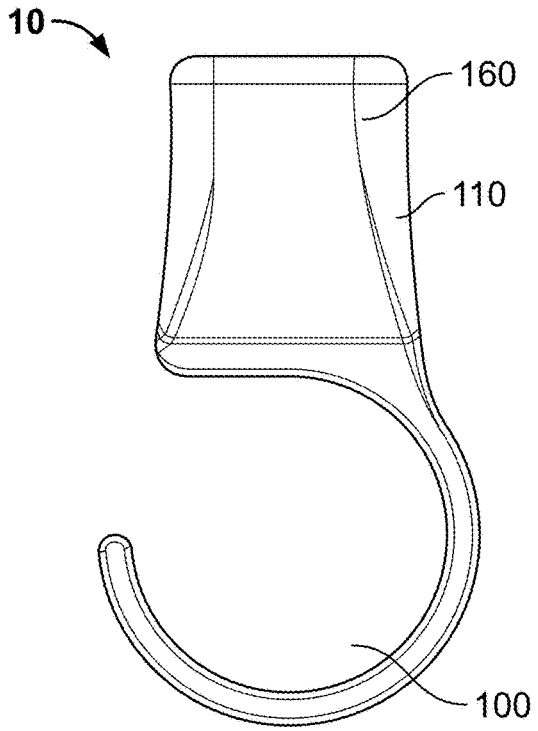
FIG. 9B provides a side view of a cane end having a conformation resembling a mirror image of a "c" shape in an unloaded conformation.
Figure 9C:
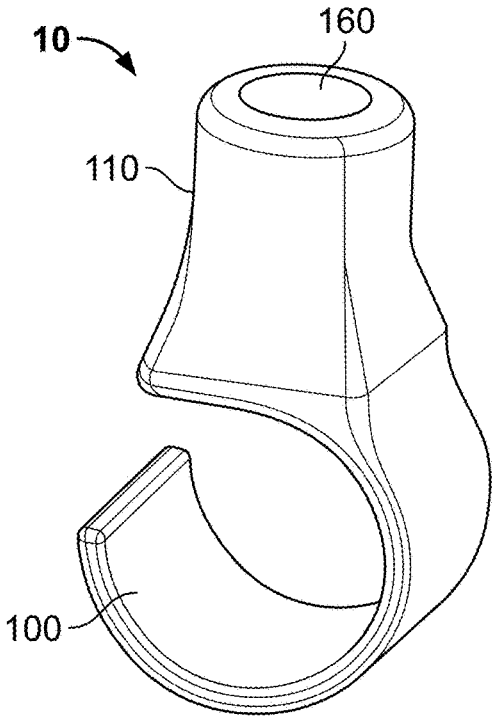
FIG. 9C provides a perspective view of a cane end having a conformation resembling a mirror image of a "c" shape in an unloaded conformation.
Figure 10A:
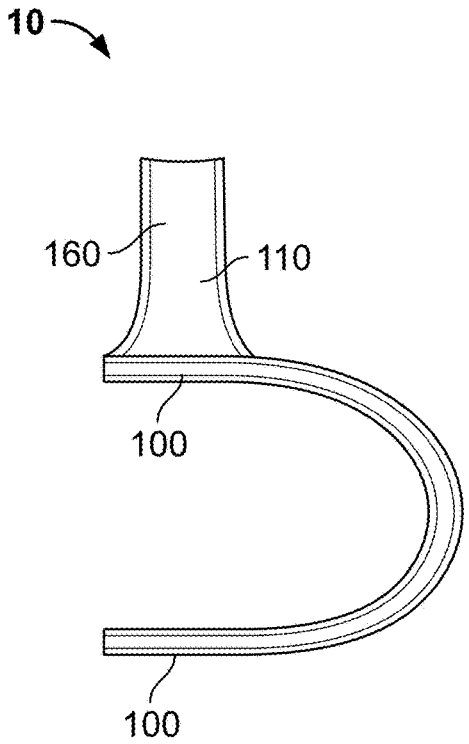
FIG. 10A provides a cross-sectional view of an alternative cane end having a conformation resembling a mirror image of a "c" shape in an unloaded conformation.
Figure 10B:
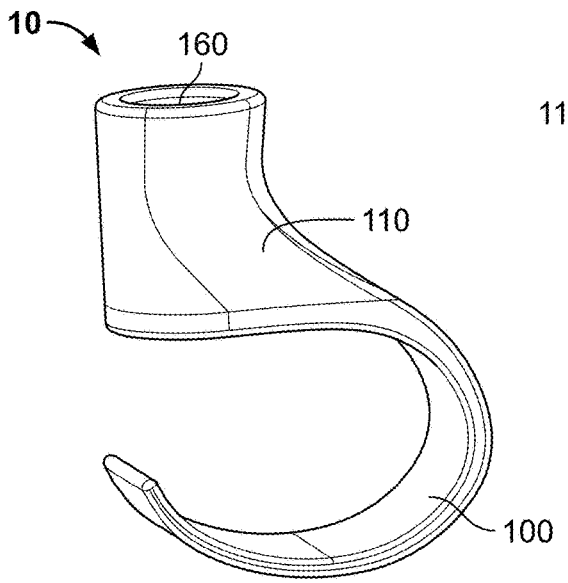
FIG. 10B provides a side view of an alternative cane end having a conformation resembling a mirror image of a "c" shape in an unloaded conformation.

Again, with reference to FIGS. 1A and 1B, the upper portion 110 also may also a curvilinear or arcuate shape. In some embodiments, the upper portion 110 has a continuously curved surface which at least partially extends into a cavity defined by the lower and upper portions. In some embodiments, the upper portion 110 comprises a top member 120 and a bottom member 130, wherein the top and bottom members (120 and 130, respectively) are continuous with each other. In some embodiments, the top member 120 is arcuate. In other embodiments, the top member 120 comprises a segment or portion that, in an unloaded conformation, is substantially parallel to the ground (when a portion of the lower portion 100 is resting on a ground). In some embodiments, the top member 120 comprises an engagement member 160 (see, e.g., FIGS. 1B and 1C). In some embodiments, the bottom member 130 curves under the top member 120 and is positioned directed under the top member 120 (see, e.g., FIGS. 1A and 1B). In some embodiments, the bottom member 130 comprises an engagement member 170. In some embodiments, the engagement members 160 and 170 are aligned with each other such that a cane shaft may be inserted through engagement member 160 and terminate within engagement member 170 (see, e.g., FIG. 8). In some embodiments, the engagement members 160 and 170 releasably engage the shaft of cane. In some embodiments, a contact point with the ground 300 on the lower portion is offset from a point of vertical loading 310 on the upper portion as depicted in FIG. 2B The upper portion may optionally comprise a catch member 140. In some embodiments, the catch member 140 is integral with the upper portion 110 or formed from a separate piece that is fastened or otherwise secured to the upper portion 110. The skilled artisan will appreciate that the position of the catch member 140 relative to the upper portion 110 may be dictated by several factors, including a relative positioning of an open end 150 of a lower portion 100 to the upper portion 110 when the cane end is under load, including a load sufficient that the open end 150 contacts the upper portion 110 (see, e.g., FIGS. 3A and 3B). The catch member 140 itself may have any size or shape, and may project from the upper portion 110, provide that it is designed to capture the open end 150 of the lower portion 100 when sufficient load is placed on the cane end. Non-limiting examples of catch members 140 are illustrated in FIGS. 1B, 2A, and 6.

In some embodiments, an anterior portion 200 and a posterior portion 205 are asymmetrical. In some embodiments, the lower portion and/or upper portion may have a variable radius of curvature. For example, any of the radii "a," "b," and/or "c" depicted in FIG. 1A may be the same or different. In some embodiments, any of the radii "a," "b," and/or "c" may vary from between 1% to 25% relative to each other. In other embodiments, any of the radii "a," "b," and/or "c" may vary from between 1% to 15% relative to each other. In yet other embodiments, any of the radii "a," "b," and/or "c" may vary from between 1% to 10% relative to each other. In further embodiments, any of the radii "a," "b," and/or "c" may vary from between 2% to 10% relative to each other. In some embodiments, a distance "d" between a top member 120 and a bottom member 130 may vary, and such distance "d" may vary based on the sizing of the number of engagement members included within the cane and their sizing and/or shape. In some embodiments, the open end 150 of the lower portion extends beyond a line "e" perpendicular to a looped end 190 of the upper portion 110.

Figure 3A:
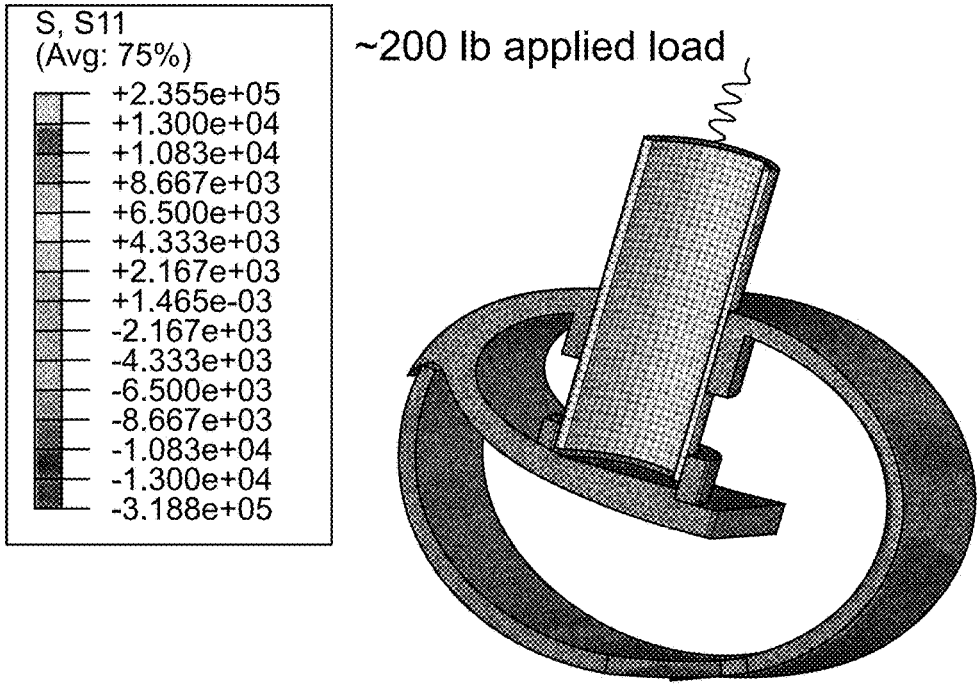
FIGS. 3A and 3B illustrate alternative perspective views of a cane end when under a load.
Figure 3B:
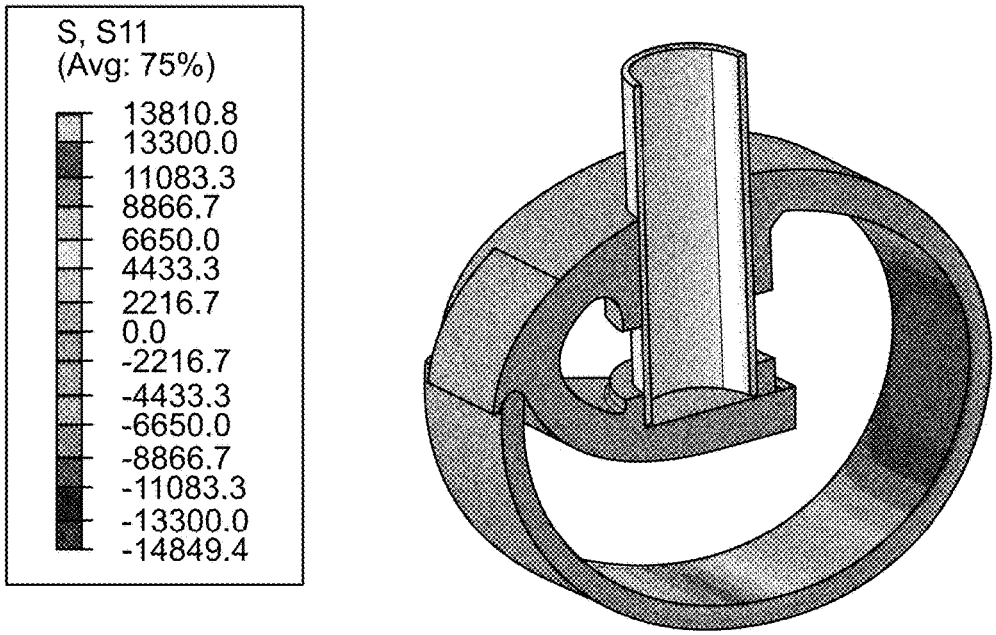
Figure 4:
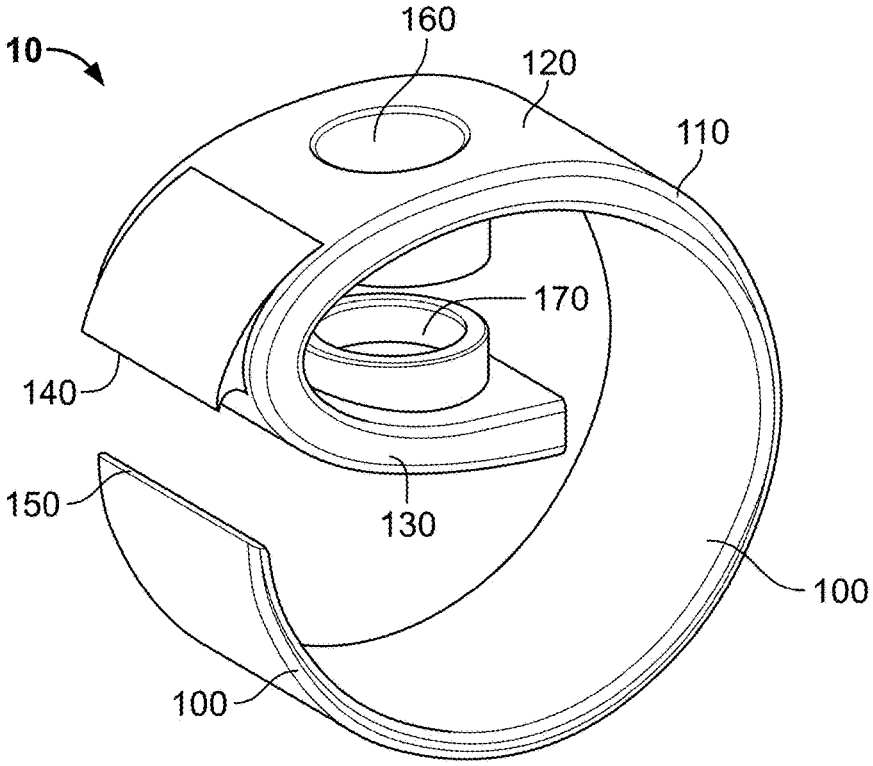
FIG. 4 illustrates a perspective view of a cane end having a conformation resembling a mirror image of an "e" shape in an unloaded conformation.
Figure 5:
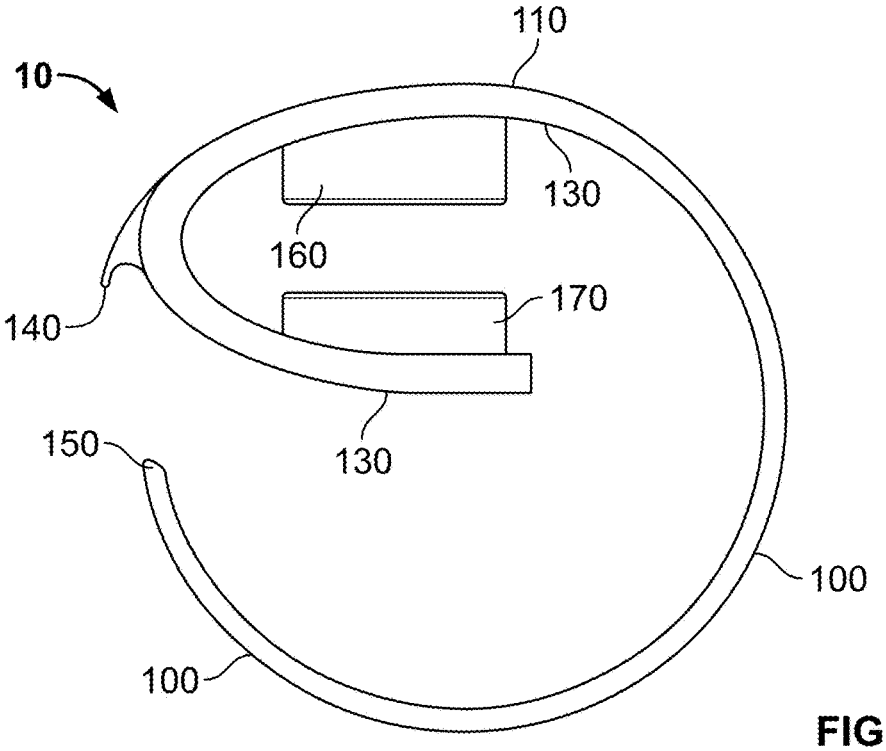
FIG. 5 sets forth a side view of an alternative cane end having a conformation resembling a mirror image of an "e" shape in an unloaded conformation.
Figure 7:
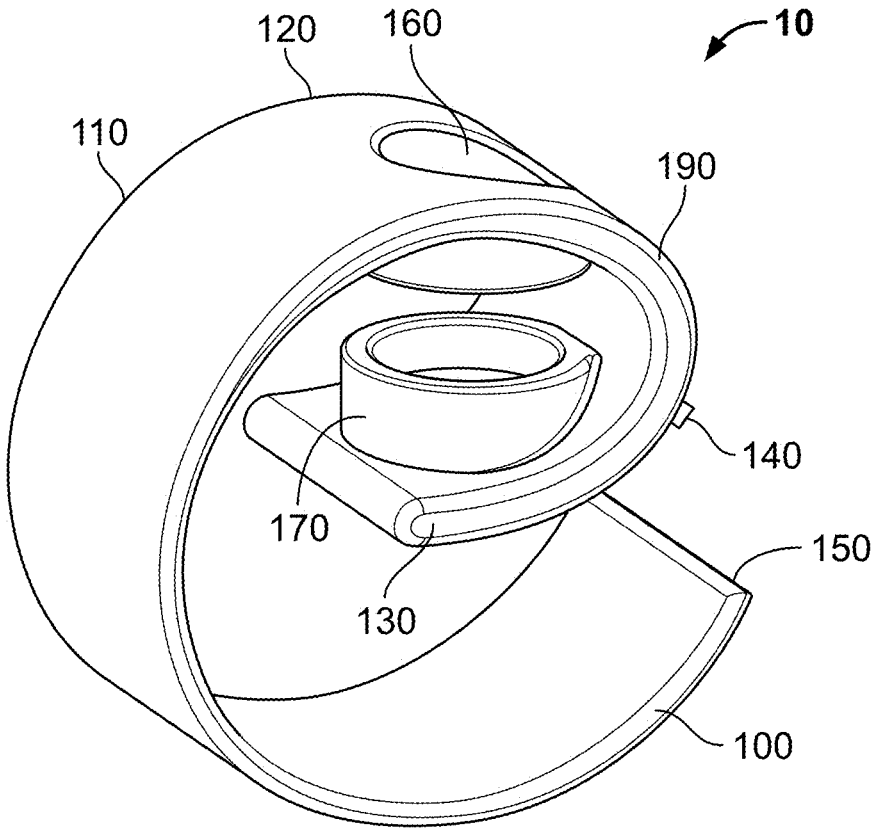
FIG. 7 sets forth a perspective view of an alternative cane end having a conformation resembling a mirror image of an "e" shape in an unloaded conformation.

The upper and lower portions 110 and 100, respectively, may have any size or shape. In some embodiments, the lower and upper portions, when considered together, roughly form a circular shape when not under load (see arc 180 which is continuous with the upper and lower portions) (see, e.g., FIGS. 1A, 4, and 7). When under load, the lower and upper portion, again when considered together, may form an ovoid shape. FIGS. 3A and 3B illustrate various alternative, and non-limiting, conformations of the cane end after application of a load. As depicted, open end 150 intercepts and contacts the catch member 140. Likewise, it is illustrated that at least one of the lower and/or upper portions deflect, compress and/or flex under load. In some embodiments, the cane end has a substantially ovoid shape when under load. The skilled artisan will appreciate that the lower portion 100, when under load, has a continuously convexly curved surface and a variable radius of curvature. In some embodiments, a surface area of the point of contact with the ground when the cane end is under load increases relative to a surface area of the point of contact with the ground when the cane end is not under load. In some embodiments, the increase is at least 10%.

FIGS. 9A, 9B, 9C, 10A, and 10B illustrate other embodiments of a cane end of the present disclosure. In some embodiments, the cane end of FIGS. 9A, 9B, 9C, 10A, and 10B have a conformation that resembles or substantially resembles a mirror image of a "c" shape when the cane end is not under a load. In these embodiments, a lower portion 100 is continuous with an upper portion 110. In some embodiments, the lower portion 100 has a continuously convexly curved surface. In some embodiments, the lower portion 100 may comprise a variable radius of curvature. The skilled artisan will appreciate that, given the curvilinear or arcuate shape of the lower portion 100, at least a portion of it will contact the ground. In some embodiments, an upper portion comprises a single engagement member 160 which accepts and releasably engages a shaft of a cane. As with the cane end embodiments described above having the "e" shape, the lower portions may have any size and/or shape.

Figure 11A:
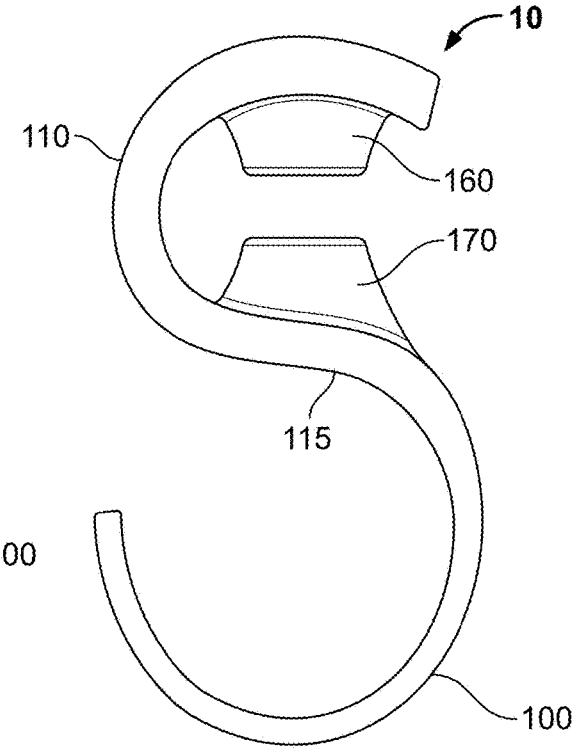
FIG. 11A provides a cross-sectional view of a cane end having a conformation resembling a "s" shape in an unloaded conformation.
Figure 11B:
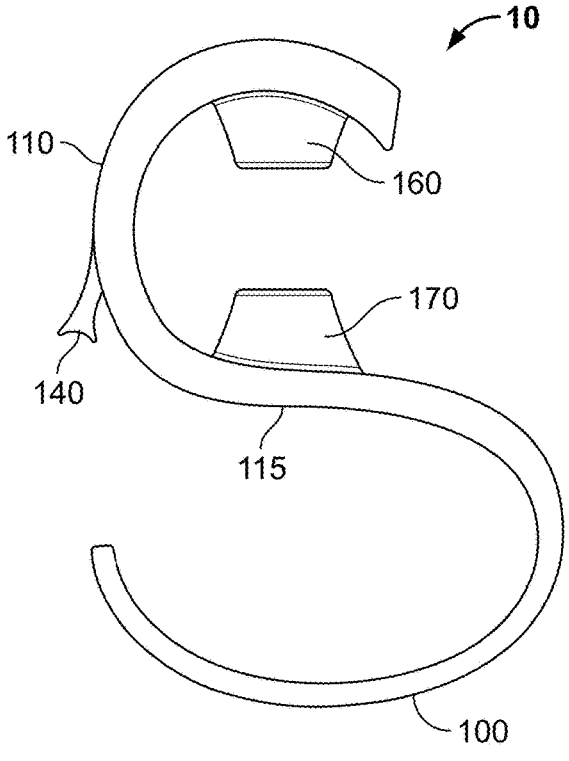
FIG. 11B provides a cross-sectional view of an alternative cane end having a conformation resembling a "s" shape in an unloaded conformation.
Figure 11C:
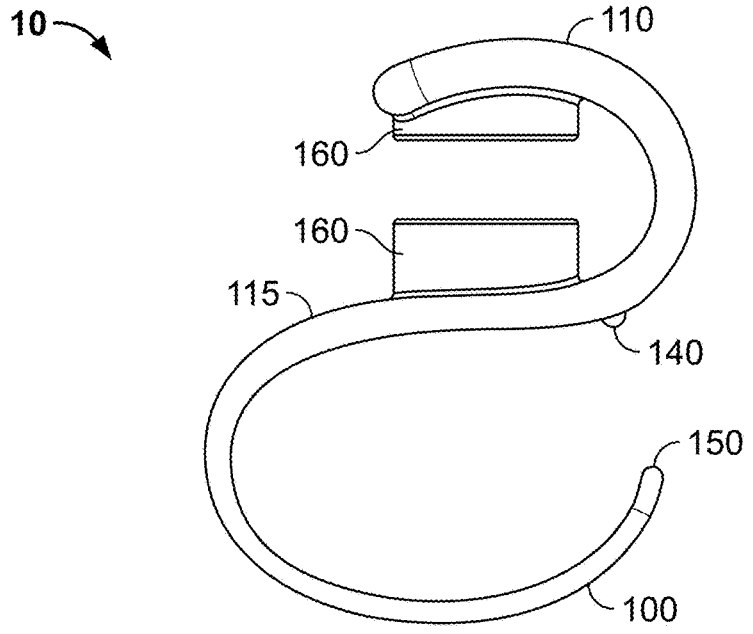
FIG. 11C provides a side view of an alternative cane end having a conformation resembling a "s" shape in an unloaded conformation.
Figure 11D:
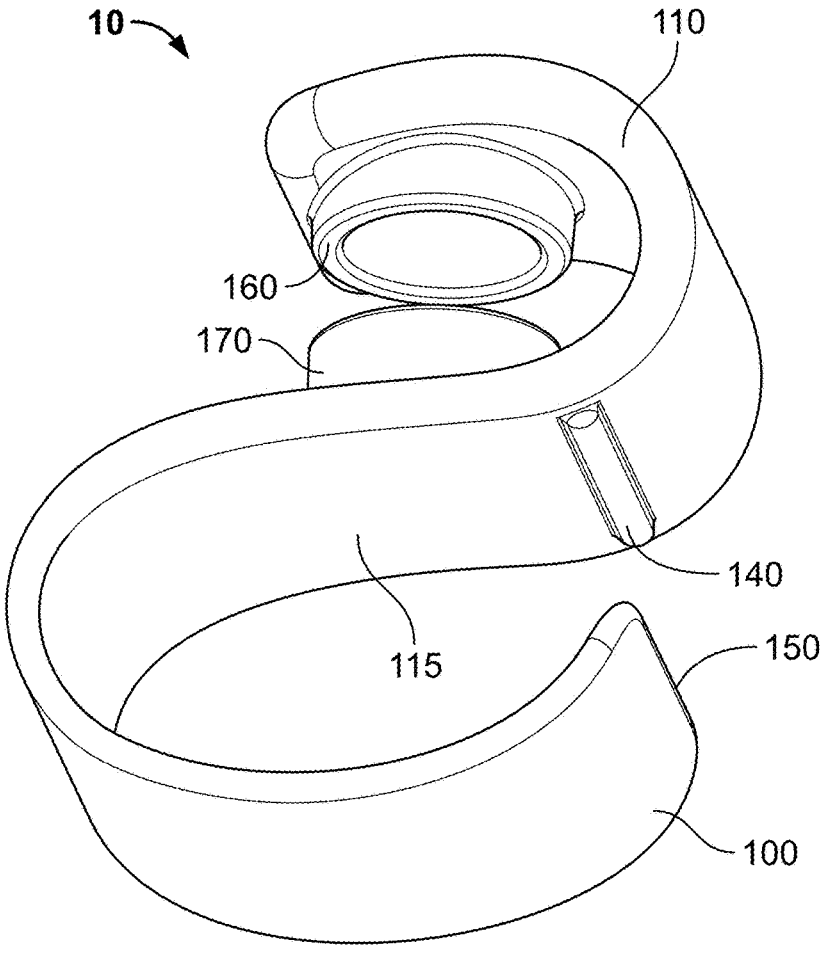
FIG. 11D provides a perspective view of a cane end having a conformation resembling a "s" shape in an unloaded conformation.
Figure 11E:
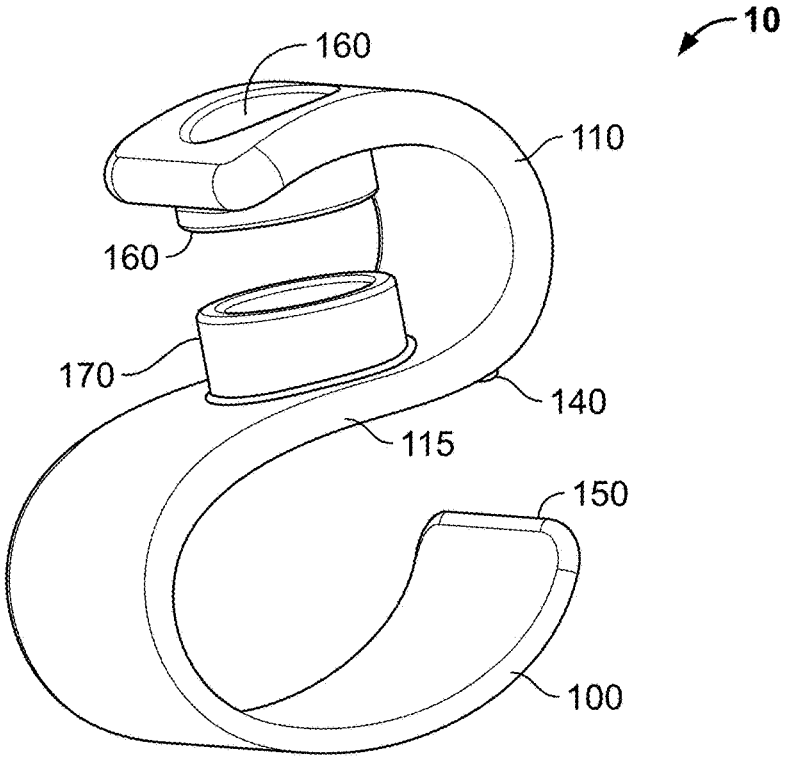
FIG. 11E provides a perspective view of a cane end having a conformation resembling a "s" shape in an unloaded conformation.
Figure 11F:
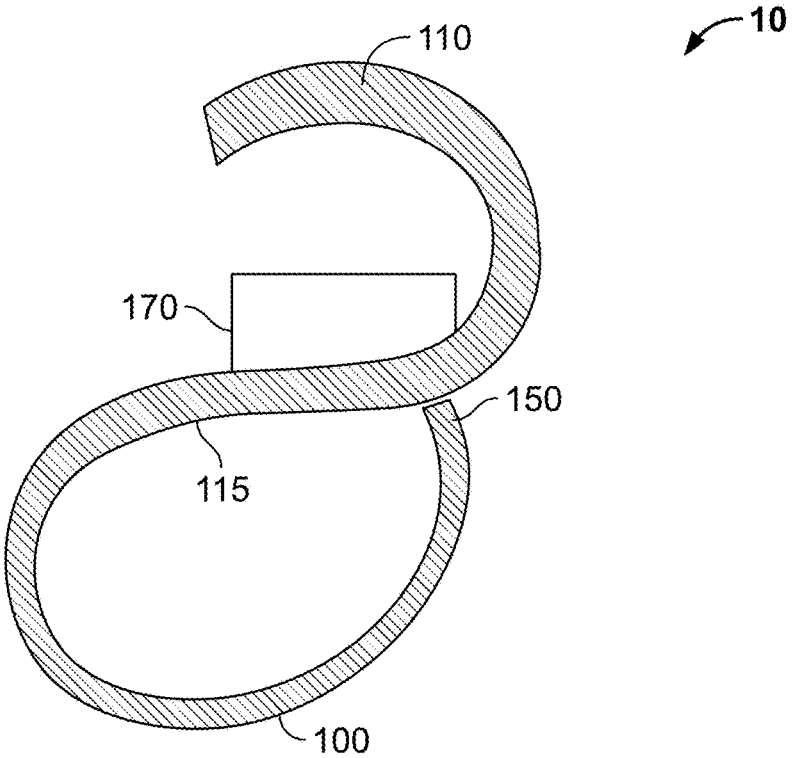
FIG. 11F provides a side view of a cane end having a conformation resembling a "s" shape in a loaded conformation.

FIGS. 11A, 11B, 11C, 11D, and 11E illustrate other embodiments of a cane end of the present disclosure. In some embodiments, the cane end of FIGS. 11A, 11B, 11C, 11D, and 11E have a conformation that resembles or substantially resembles a "s" shape when the cane is not under load. In these embodiments, a lower portion 100 is continuous with an upper portion 110 and a middle portion 115. In some embodiments, the lower portion 100 has a continuously convexly curved surface. In some embodiments, the lower portion 100 may comprise a variable radius of curvature. The skilled artisan will appreciate that, given the curvilinear or arcuate shape of the lower portion 100, at least a portion of it will contact the ground when in use. In some embodiments, at least a portion of the middle portion 115 may be substantially parallel with the ground (and substantially perpendicular to a shaft of a cane inserted into engagement members 160 and 170). In other embodiments, at least a portion of the middle portion may be set on an angle relative to the ground. In some embodiments, the middle portion is set at an angle ranging from between about 1 degree to about 65 degrees. In other embodiments, at least a portion of the middle portion is set at an angle ranging from between about 5 degrees to about 50 degrees. In yet other embodiments, at least a portion of the middle portion is set at an angle ranging from between about 2.5 degrees to about 40 degrees. In yet further embodiments, at least a portion of the middle portion is set at an angle ranging from between about 2.5 degrees to about 20 degrees. In some embodiments, the middle portion comprises an engagement member 170. In some embodiments, at least a portion of the upper portion 110 comprises a segment which is parallel to the ground (and substantially perpendicular to a shaft of a cane inserted into engagement members 160 and 170). In some embodiments, the upper portion comprises an engagement member 160. In some embodiments, engagement members 160 and 170 are vertically aligned with one another (see, e.g., FIG. 11C). In some embodiments, a point of ground contact is offset from a point of vertical loading on the upper and middle portions. With reference to FIGS. 11F and 12, when the cane end is under load, an open end 150 of the lower portion 100 may contact the upper portion. As with the cane end embodiments described above having the "e" shape, the lower and upper portions may independently have any size and/or shape. In some embodiments, the upper and lower engagement members are separated by a distance ranging from about 0.1 inches to about 0.5 inches. In some embodiments, the upper and lower engagement members are separated by a distance ranging from about 0.1 inches to about 0.4 inches.

In some embodiments, a thickness of the upper portion may be uniform or variable. In some embodiments, the upper portion may have a first thickness and a second thickness, whereby the thickness tapers from the first thickness to the second thickness. Likewise, in some embodiments, a thickness of the lower portion may be uniform or variable. In some embodiments, the lower portion may have a first thickness and a second thickness, whereby the thickness tapers from the first thickness to the second thickness. In some embodiments, the lower portion comprises a uniform thickness which is similar (e.g. within 10%) to the second thickness (after tapering from the first thickness) of the upper portion. The skilled artisan will appreciate that by varying the thickness of the upper and/or lower portions or any segment thereof, the cane end may be designed to facilitate different loads. In some embodiments, an average thickness of the upper portion is greater than an average thickness of the lower portion. In some embodiments, an average thickness of the upper portion is at least 15% greater than an average thickness of the lower portion. By way of example, the cane ends in each of the embodiments illustrated in FIGS. 1B, 2A, 5, and 6 may have upper portions that may each have different thicknesses or tapers. In some embodiments, a thickness of any portion may range from 0.05 inches to 0.5 inches. In some embodiments, a thickness of any portion may range from 0.05 inches to 0.4 inches. In some embodiments, a thickness of any portion may range from 0.1 inches to 0.5 inches. In some embodiments, a thickness of any portion may range from 0.1 inches to 0.4 inches.

Figure 12A:
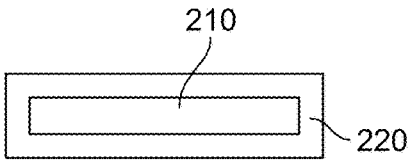
FIG. 12A illustrates a bottom view of the lower portion of a cane end comprising one or more traction members.
Figure 12B:
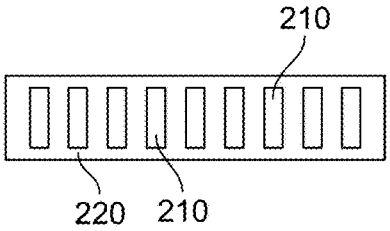
FIG. 12B illustrates a bottom view of the lower portion of a cane end comprising one or more traction members.
Figure 12C:
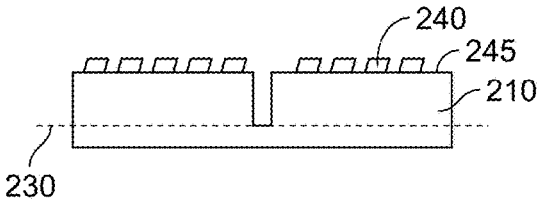
FIG. 12C illustrates a side view of a traction member or a portion thereof.

With reference to FIGS. 12A and 12B, in some embodiments, an exterior surface 220, i.e. a ground contacting surface, of the lower portion 100 further comprises one or more traction members 210. The traction members may be discrete elements, such as depicted in FIG. 12B, or may be a single continuous traction member such as depicted in FIG. 12A. The traction members 210 may each independently have any size or shape (e.g. dots, squares, rectangles, circles, ovals, etc.), provided that they conform to any curvature of the exterior surface 220. In some embodiments, the traction members 210 have a wear indicator 230 allowing an operator to monitor wear (see, e.g., FIG. 12C). Of course, the skilled artisan will appreciate that any of the wear indicators may comprise the same or difference materials, e.g. wear indicators that are positioned along the exterior surface which contact the ground more often may be more or less resilient than those which contact the ground less often. In some embodiments, the traction members 210 that contact the ground more often are comprised of a material that is more compressible than other traction members to help facilitate the absorption of shock, to help balance loading, and/or to help facilitate correct positioning of the cane end while in use. In some embodiments, the traction members 210 may further comprise a plurality of projections 240 extending from an outer surface 245 of the traction member 240, such as to provide an increased surface area for ground contact and/or to facilitate stability of the cane end while in use. In some embodiments, the traction members 210 are independently removable such that they may be replaced as needed. In some embodiments, at least 10% of the exterior surface 220 comprises traction members. In other embodiments, at least 15% of the exterior surface 220 comprises traction members. In further embodiments, at least 25% of the exterior surface 220 comprises traction members. In yet further embodiments, at least 50% of the exterior surface 220 comprises traction members. In some embodiments, the traction member is comprised of natural or synthetic rubbers, latex, plastics, plastic composites, polymers (e.g. polyurethanes, ethylene vinyl acetate, or any other polymers, including those recited herein with regard to materials for the body of the cane end). In some embodiments, the material constituting the traction members is flexible and/or compressible and softer than the material comprising the lower portion 100 of the cane end.

In some embodiments, at least a portion of the exterior surface 220 of the lower portion comprises a coating. In some embodiments, the coating is sprayed on. In other embodiments, the lower portion is dipped in a solution to facilitate application of the coating. In some embodiments, the coating is a water proofing coating. In other embodiments, the coating is one that increases the rigidity of the lower portion. In other embodiments, the coating is one that provides increased traction, e.g. a rubber, a silicone, etc. In other embodiments, the traction members 210 may be applied to the coated surface (i.e. the exterior surface 220 is the coated surface).

Figure 13:
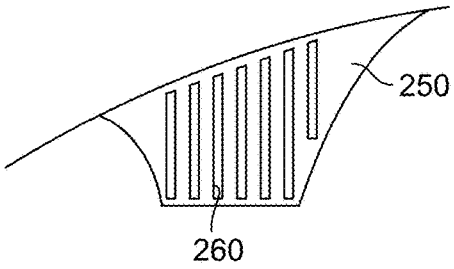
FIG. 13 sets forth a cross-section view of an engagement member according to one embodiment of the present disclosure.
Figure 14:
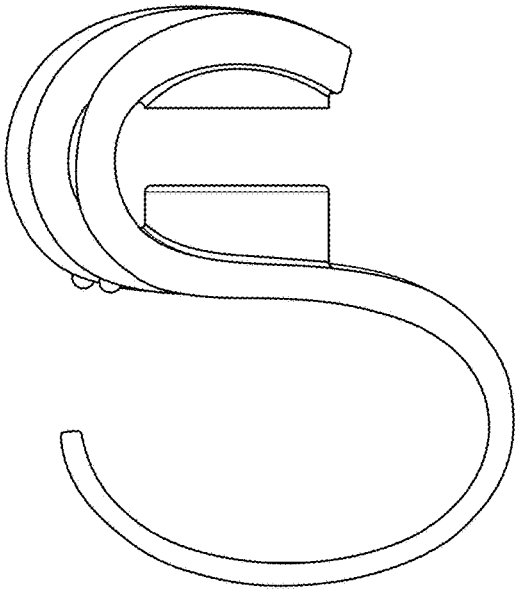
FIG. 14 illustrates the profiles of three different "s" shaped cane ends, where each different "s" shaped cane end comprises a different upper portion.

In embodiments, the engagement members 160 and 170 may be constructed of natural or synthetic rubbers, latex, plastics, plastic composites, polymers (e.g. polyurethanes, ethylene vinyl acetate, etc.). With reference to at least FIG. 13, in some embodiments, the engagement members 160 and 170 may be constructed of the same material as the upper portion 110 of the cane end, but an inner surface 250 of the engagement member may be comprised of a material selected from natural or synthetic rubbers, latex, plastics, plastic composites, polymers (e.g. polyurethanes, ethylene vinyl acetate, etc.). In some embodiments, the inner surface 250 of an engagement member comprises one or more friction increase members 260, where the one or more friction increasing members may be comprised of a material selected from natural or synthetic rubbers, latex, plastics, plastic composites, polymers (e.g. polyurethanes, ethylene vinyl acetate, etc.).

In some embodiments, the cane is comprised of a resilient material. The resilient material's physical properties as they relate to stiffness, flexibility, and strength may, in some instances, be determined by the thickness of the material. In some embodiments, a thinner material may deflect, compress, and/r flex easier than a thicker material of the same density. The material utilized, as well as the physical properties, are associated with the stiffness to flexibility characteristics of the upper and lower portions of any cane end.

The cane end may be constructed from any material or combination of materials. Suitable materials include composites, carbon fiber, forms of graphic, polymers, co-polymers, polymer blends, co-polymer blends, and resins. Other materials for the cane end may include, for example, stainless steel, titanium alloy, flexible titanium, aluminum alloy, memory metals (as that term is understand by those of ordinary skill in the art), chromium alloy, and other metals or metal alloys. Yet other materials may also include, for example, fiberglass, fiberglass laminates, wood, wood laminates, metal laminates, and Kevlar. Yet additional materials fiber-encased resinous materials, rubber, latex, and synthetic rubber.

In some embodiments, the cane end is a solid piece of material, e.g. plastic in nature, having shape-retaining characteristics when deflected, compressed, and/or flexed. In some embodiments, the cane end is a monolithic piece comprised of (i) a high strength graphite, laminated with epoxy thermosetting resins, (ii) extruded plastic utilized under the tradename of Delran, or (iii) degassed polyurethane copolymers. Without wishing to be bound by any particular theory, it is believed that the functional qualities associated with these materials, and the other described herein, afford high strength with low weight and minimal creep. In some embodiments, the thermosetting epoxy resins are laminated under vacuum utilizing standards defined by the prosthetics industry. In some embodiments, the polyurethane copolymers (described herein) can be poured into negative molds and the extruded plastic can be machined.

Non-limiting examples of polymers include polyethylenes, polypropylenes, polybutylenes, low vinyl polybutadienes polystyrenes, butadiene-styrene copolymers, SMA polymers, ABS polymers, polydicyclopentadienes, epoxies, polyurethanes, cyanate esters, poly(phenylene oxide), EPDM polymers, cyclic olefin copolymers (COC), polyimides, bismaleimides, phosphazenes, olefin-modified phosphazenes, acrylates, vinyl esters, polylactones, polycarbonates, polysulfones, polythioethers, polyetheretherketones (PEEK), polydimethylsiloxanes (PDMS), polyethylene terephthalates (PET), polybutylene terephthalates (PBT), and other commercially-available polymers.

In some embodiments, the material is a polylactic acid resin. In some embodiments, the polylactic acid resin is copolymerized with carboxylic acids, polyhydric alcohols, hydroxycarboxylic acids, and lactones. Specific examples include polyvalent carboxylic acids, such as oxalic acid, malonic acid, succinic acid, glutaric acid, adipic acid, azelaic acid, sebacic acid, dodecanedioic acid, fumaric acid, cyclohexanedicarboxylic acid, terephthalic acid, isophthalic acid, phthalic acid, 2,6-naphthalenedicarboxylic acid, 5-sodiumsulfoisophthalic acid, and 5-tetrabutylphosphoniumsulfoisophthalic acid; polyhydric alcohols, such as ethylene glycol, propylene glycol, butanediol, heptanediol, hexanediol, octanediol, nonanediol, decanediol, 1,4-cyclohexanedimethanol, neopentyl glycol, glycerol, trimethylolpropane, pentaerythritol, bisphenol A, an aromatic polyhydric alcohol prepared by making ethylene oxide undergo addition reaction to bisphenol A, diethylene glycol, triethylene glycol, polyethylene glycol, polypropylene glycol, and polytetramethylene glycol; hydroxycarboxylic acids, such as glycolic acid, 3-hydroxybutyric acid, 4-hydroxybutyric acid, 4-hydroxyvaleric acid, 6-hydroxycaproic acid, and hydroxybenzoic acid; lactones, such as glycolide, ϵ-caprolactone glycolide, ϵ-caprolactone, β-propiolactone, δ-butyrolactone, β- or γ-butyrolactone, pivalolactone, and δ-valerolactone. One or two or more of such copolymerization components may be used.

In some embodiments, the material is a styrene-based resin. The styrene-based resin to be used in an embodiment of the present disclosure denotes a copolymer obtained by copolymerizing at least an aromatic vinyl-based monomer and a vinyl cyanide-based monomer. Moreover, it also may be a copolymer obtained by further copolymerizing an alkyl unsaturated carboxylate-based monomer and/or another vinyl-based monomer copolymerizable therewith according to need.

The styrene-based resin can be obtained by subjecting a monomer mixture including an aromatic vinyl-based monomer and a vinyl cyanide-based monomer and, according to need, an alkyl unsaturated carboxylate-based monomer and/or another vinyl-based monomer copolymerizable therewith to bulk polymerization, bulk suspension polymerization, solution polymerization, precipitation polymerization or emulsion polymerization each known in the art.

The aromatic vinyl-based monomer is not particularly limited, and specific examples thereof include styrene, α-methylstyrene, o-methylstyrene, p-methylstyrene, c-ethylstyrene, p-ethylstyrene, and p-t-butylstyrene. Especially, styrene or α-methylstyrene is preferably used. These may be used individually or in combination. The monomer components constituting the styrene-based resin contain the aromatic vinyl-based monomer preferably in a content of 20% by weight or more, more preferably in a content of 50% by weight or more.

There is no particular limitation with respect to the vinyl cyanide-based monomer, and specific examples thereof include acrylonitrile, methacrylonitrile and ethacrylonitrile. Especially, acrylonitrile is preferably used. These may be used individually or in combination.

From the viewpoint of improving the productivity and the mechanical strength of a filament to be obtained using a material for modeling, the monomer components constituting the styrene-based resin contain the vinyl cyanide-based monomer preferably in a content of 15% by weight or more, more preferably in a content of 20% by weight or more.

There is no particular limitation with respect to the alkyl unsaturated carboxylate-based monomer, an ester of an alcohol having 1 to 6 carbon atoms and (meth)acrylic acid is suitable. Such an ester may further have a substituent and examples of such a substituent include a hydroxy group and chlorine. Specific examples of the alkyl unsaturated carboxylate-based. monomer include methyl (meth)acrylate, ethyl (meth)acrylate, n-propyl (meth)acrylate, n-butyl (meth)acrylate, t-butyl (meth)acrylate, n-hexyl (meth)acrylate, cyclohexyl (meth)acrylate, chloromethyl (meth)acrylate, 2-chloroethyl (meth)acrylate, 2-hydroxyethyl (meth) acrylate, 3-hydroxypropyl (meth)acrylate, 2,3,4,5,6-pentahydroxyhexyl (meth)acrylate, and 2,3,4,5-tetrahydroxypentyl (meth)acrylate. Especially, methyl methacrylate is preferably used. These may be used individually or in combination. The term "(meth)acrylic acid" as used herein denotes acrylic acid or methacrylic acid.

The other vinyl-based monomer has no particular limitations as long as it can be copolymerized with the aromatic vinyl-based monomer, the vinyl cyanide-based monomer and, according to need, the alkyl unsaturated carboxylate-based monomer, and specific examples thereof include maleimide-based monomers, such as N-methylmaleimide, N-ethylmaleimide, N-cyclohexylmaleimide, and N-phenylmaleimide, vinyl-based monomers having a carboxyl group or a carboxylic anhydride group, such as acrylic acid, methacrylic acid, maleic acid, monoethyl maleate, maleic anhydride, phthalic acid, and itaconic acid, vinyl-based monomers having a hydroxy group, such as 3-hydroxy-1-propene, 4-hydroxy-1-butene, cis-4-hydroxy-2-butene, trans-4-hydroxy-2-butene, 3-hydroxy-2-methyl-1-propene, cis-5-hydroxy-2-pentene, trans-5-hydroxy-2-pentene, and 4,4-dihydroxy-2-butene, vinyl-based monomers having an amino group or its derivative, such as acrylamide, methacrylamide, N-methylacrylamide, butoxymethylacrylamide, N-propylmethacrylamide, aminoethyl acrylate, propylaminoethyl acrylate, dimethylaminoethyl methacrylate, ethylaminopropyl methacrylate, phenylaminoethyl methacrylate, cyclohexylaminoethyl methacrylate, N-vinyldiethylamine, N-acetylvinylamine, allylamine, methallyl amine, N-methylallylamine, and p-aminostyrene, and vinyl-based monomers having an oxazoline group, such as 2-isopropenyloxazoline, 2-vinyl-oxazoline, 2-acryloyl-oxazoline, and 2-styryl-oxazoline. These may be used individually or in combination.

While there is no particular limitation with the molecular weight of the styrene-based resin, from the viewpoint of securing extrusion stability at the time of producing a filament obtained using a material for modeling and mechanical strength necessary for collecting a filament by winding it around a bobbin, the weight average molecular weight is preferably 50,000 or more, more preferably 80,300 or more. On the other hand, from the viewpoint of further lowering the melt viscosity at low temperatures of a filament obtained using a material for modeling, the weight average molecular weight is preferably 400,000 or less. The weight average molecular weight as referred to herein denotes a polystyrene-equivalent weight average molecular weight measured by GPC using tetrahydrofuran as a solvent.

Specific examples of the styrene-based resin to be used in the present disclosure include acrylonitrile-styrene (AS) resin and methyl methacrylate-acrylonitrile-styrene (MAS) resin. Two or more of them may be used in combination: for example, AS resin and MAS resin may be used in combination.

In some embodiments, the material is a polyester resin. Examples of the aliphatic polyester resin include polyethylene succinate, polybutylene succinate, polybutylene adipate, polyethylene adipate, polybutylene (succinate/adipate), polyethylene (succinate/adipate), polyhydroxy butyrate, and polyhydroxy (butyrate/hexanoate). Examples of the aliphatic aromatic polyester resin include polybutylene (terephthalate/succinate), polyethylene (terephthalate/succinate), polybutylene (terephthalate/adipate), polyethylene (terephthalate/adipate), polyethylene (terephthalate/sulfoisophthalate), polybutylene (terephthalate/sebacate), and polyethylene (terephthalate/sebacate). Of the polyester resins provided as examples previously, examples of the copolymerized polyester resin include polybutylene (succinate/adipate), polyethylene (succinate/adipate), polyhydroxy(butyrate/hexanoate), polybutylene (terephthalate/succinate), polyethylene (terephthalate/succinate), polybutylene (terephthalate/adipate), polyethylene (terephthalate/adipate), polyethylene (terephthalate/sulfoisophthalate), polybutylene (terephthalate/sebacate), and polyethylene (terephthalate/sebacate).

In some embodiments, the material is a thermoplastic elastomer including any of a co-polymer, a random copolymer, a block copolymer, and a graft copolymer. Examples of said co-polymer, random copolymer, and block copolymer include an ethylene-propylene copolymer, an ethylene-propylene-nonconjugated diene copolymer, an ethylene-butene-1 copolymer, acrylic rubbers, an ethylene-acrylic acid copolymer and its alkali metal salts (so-called ionomer), an ethylene-glycidyl (meth)acrylate copolymer, an ethylene-alkyl (meth)acrylate copolymer (for example, an ethylene-methyl acrylate copolymer, an ethylene-ethyl acrylate copolymer, an ethylene-butyl acrylate copolymer, and an ethylene-methyl methacrylate copolymer), an ethylene-vinyl acetate copolymer, an acid-modified ethylene-propylene copolymer, diene rubber (for example, polybutadiene, polyisoprene, and polychloroprene), a copolymer of diene with a vinyl monomer (for example, a styrene-butadiene random copolymer, a styrene-butadiene block copolymer, a styrene-butadiene-styrene block copolymer, a styrene-isoprene random copolymer, a styrene-isoprene block copolymer, a styrene-isoprene-styrene block copolymer, a styrene-ethylene-butylene-styrene block copolymer, a styrene-ethylene-propylene-styrene block copolymer, and a butadiene-acrylonitrile copolymer) or its hydrogenated product, polyisobutylene, a copolymer of isobutylene with butadiene or isoprene, natural rubber, thiokol rubber, polysulfide rubber, silicone rubber, polyurethane rubber, polyether rubber, epichlorohydrin rubber, polyester-based elastomer, or polyamide-based elastomer. Moreover, polymers varying in degree of crosslinking, polymers having various microstructures, e.g., cis-structure and trans-structure, and a multilayer structure polymer composed of a core layer and one or more shell layers covering the core layer can also be used.

In producing such a co-polymer, a random copolymer, and a block copolymer, such monomers as other olefins, dienes, acrylic acid, alkyl unsaturated carboxylate-based monomer (particularly preferably, an acrylate or a methacrylate) may be copolymerized. Of these thermoplastic elastomers, a polymer including acrylic units and a polymer including units having an acid anhydride group and/or a glycidyl group are preferable. Particularly preferable examples of the acrylic unit include a methyl methacrylate unit, a methyl acrylate unit, an ethyl acrylate unit, or a butyl acrylate unit, and preferable examples of the unit having an acid anhydride group or a glycidyl group include a maleic anhydride unit or a glycidyl methacrylate unit.

In some embodiments, the material for the cane end is a graft copolymer including a product obtained by graft polymerizing a monomer mixed component including an aromatic vinyl-based monomer and a vinyl cyanide-based monomer to a rubbery polymer (r).

Such a graft copolymer can be obtained, for example, by subjecting a monomer mixed component including an aromatic vinyl-based monomer and a vinyl cyanide-based monomer to bulk polymerization, bulk suspension polymerization, solution polymerization, precipitation polymerization, or emulsion polymerization known in the art, in the presence of a rubber polymer (r). The graft copolymer can include not only a graft copolymer in which monomer components are graft polymerized to a rubbery polymer (r) but also a polymer of monomer components not having been grafted to a rubbery polymer (r). The monomer components to be graft polymerized include at least an aromatic vinyl-based monomer and a vinyl cyanide-based monomer and, according to need, an alkyl unsaturated carboxylate-based monomer and another vinyl-based monomer copolymerizable therewith. Examples of the aromatic vinyl-based monomer, the vinyl cyanide-based monomer, the alkyl unsaturated carboxylate-based monomer, and another vinyl-based monomer copolymerizable therewith include those provided as examples of the monomers that constitute the styrene-based resin.

In some embodiments, cane end or any portion thereof is produced directly by machining or milling a block of solid material. In other embodiments, the cane end or any portion thereof is produced by 3D printing. In other embodiments, the cane end or any portion thereof is produced from a mold. In some embodiments, entire cane end is formed from a single machined, milled, or molded piece. In some embodiments, the upper and lower portions of the cane end are produced according to a first manufacturing method and the engagement members are produced according to a second manufacturing method.

In some embodiments, the cane end further comprises one or more sensors that can measure or gather data indicative of a performance characteristic or gait information of the cane end or its use. In some embodiments, the cane end includes a mechanism for wirelessly transmitting data gathered by the one or more sensors (e.g., a transmitter or transceiver). The data can be transmitted to, for example, a remote computer, another device, and/or a cloud. The data can be processed on the remote computer or other device, or retrieved from the cloud and analyzed or processed. The data and/or processed data can be used by, for example, a medical doctor, physical therapist, or the manufacturer to predict and prevent potential failure, evaluate potential safety hazards, analyze performance, etc. In some embodiments, the sensors include accelerometers, pressure sensors, strain sensors, and temperature sensors.

EXAMPLES

Example 1—"s" Shaped Cane End

Material: 30% Glass Filled Polypropylene
Flexible region thickness: 0.1"
Part width: 1.5"
Radius of curvature: 1.25"
Moment arm for load application: 1"
Displacement at cane end tip: 0.75"

Example 2—Method of Use of a Cane End

With the user standing with feet shoulder-width apart and with the cane at their side, the user advances the cane out directly in front of them or out and slightly laterally to the side. Most users would then take a step with the ipsilateral foot although some would take a step with the contralateral foot relative to the side the cane is on. The user could then apply compression to the cane just before or as they are advancing their feet; or if they don't need more or increased ability they would not and or don't have to comply compression to the cane. The cane should never land behind the user's leg and the user, for the most part, should only step up to level of where the cane is and never beyond that. When the cane bottom is compressed there is a posterior stop that does not allow the cane to fully compress.

Example 3—Comparison Between the Cane End of the Present Disclosure and a Four-Legged Cane To appropriately use a quad cane (i.e. a four-legged cane, including one with a wide base or a narrow base) the user has to be able to pick up the cane and place all four prongs down on the surface at the same time in order for it to be said to be safe. On the other hand, with the cane of the present disclosure, the user only need advance the cane without worrying about placing it down with another three prongs. There are also exist differences with regard to the wrist and elbow actions when using a quad cane as the user is literally picking it up and placing it down to have all four prongs come in contact with the surface at the same time. On the other hand, with the cane of the present disclosure, as it rolls the user enjoys a more natural motion for the wrist and elbow.

Example 4

Investigating actual loads put on the cane in use is an important study to understand how the cane is used and how it will fail. To this end, we took a load cell from a static test frame and performed some informal loading trials to understand some worst case scenario loads that could be seen by extremely favoring the cane in use. Three cases were carried out three times each by one user. Therefore, while this data is by no means statistically significant, it gives an idea of what to expect in use. The three cases were normal walking with a cane, extremely favoring the cane, and using the cane to stand up from a sitting position. The subject in all three trials was a male, 25 years old, weighing 215 pounds, in overall good health. All experiments were performed using a cane end having substantially the mirror image of an "e" shape, as disclosed herein.

Figure 15A:
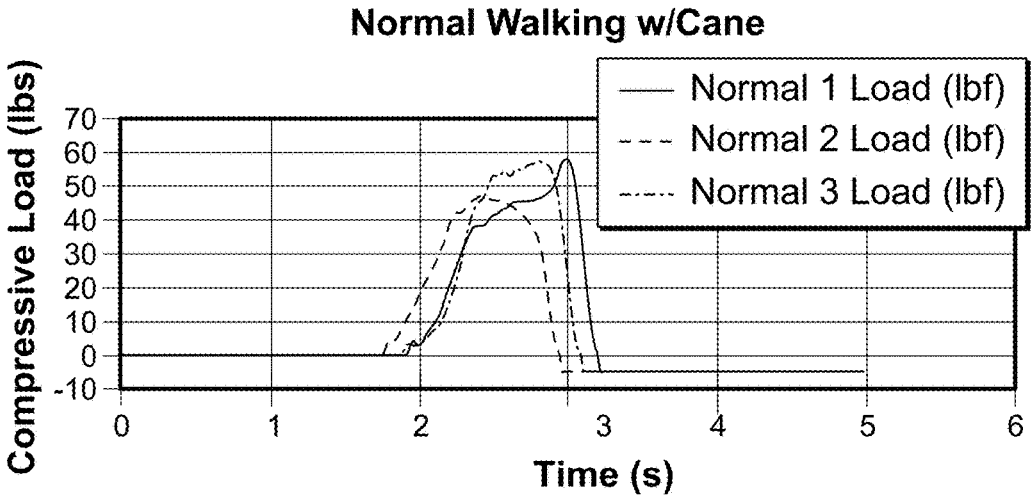
FIGS. 15A, 15B, and 15C provide graphs illustrating compression load over time.

First, for the normal walking case, the user walked with the cane as though they were rehabilitating a leg injury but were not completely favoring the cane. This was called the normal case. The plot for this case can be seen in FIG. 15A. In the normal walking case, the user exerted an average maximum load of 54.1 pounds with a maximum of 57.9 pounds. This is 27% of the user's body weight. Therefore, in average use, the cane end will see around 30% of its user's body weight.

Figure 15B:
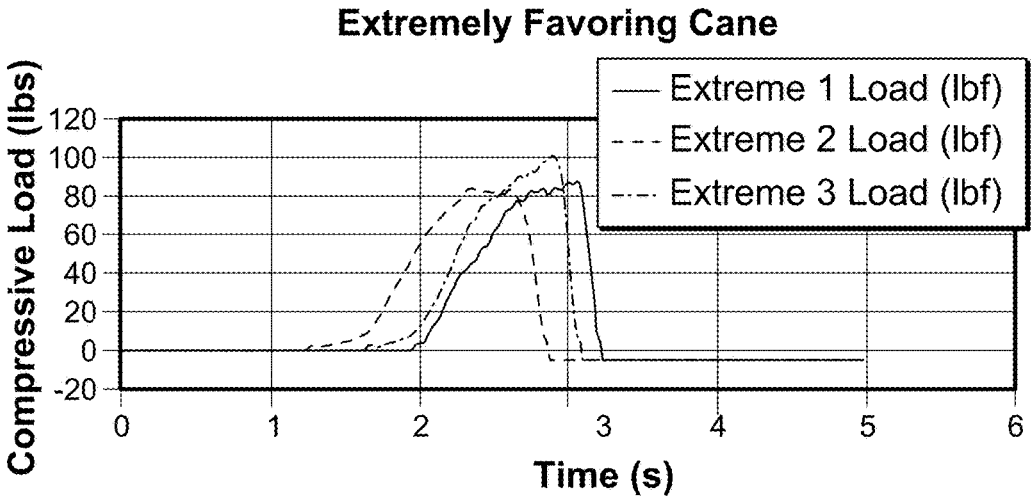

The next case is the extremely favoring case. In this case, the user favored the cane as much as possible while remaining stable. This was also done in a dynamic walking motion. The extreme case has an average maximum load of 90.8 pounds with a maximum load of 100.9 pounds. This is ~47% of the user's body weight. Therefore, in use, the most the cane will possibly see in proper use is 50% of the user's body weight. This is logical as a person has two feet splitting their body weight evenly (see FIG. 15B).

Figure 15C:
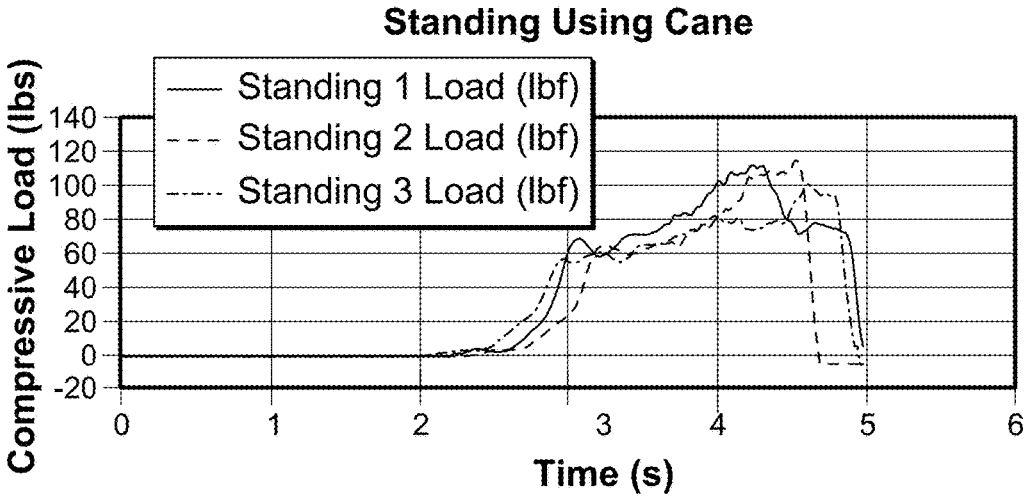

The last case is standing from a chair. Often, people using a cane will place it directly in front of them and then press up from the cane to stand from a chair. This is technically not the intended use of the cane; however, it will happen in use and must not fail. This is the worst-case loading, an average maximum load of 112 pounds with an overall maximum of 117.8 pounds. This is 55% of the user's body weight. It is important to note that the user exerted as much force on the cane as possible and noticed some discomfort in his shoulders and wrists following the 3 trials. This would be the absolute extreme for this unintended use (see FIG. 15C).

Following this, we can see that if the failure load of the cane was 140 pounds, the maximum body weight of a user, with no factor of safety, was 255 pounds. This was below the 300-pound body weight rating on the cane itself. Including a factor of safety of 1.5, the cane would need to withstand 250 pounds of load to support a 300-pound patient. Again, the modeling loads were conservative and likely lower than the real parts would withstand.

Example 5—Finite Element Analysis (FEA)

FEA analysis was performed on a cane end having substantially resembling a mirror image of an "e" shape. Ultimately, the ideal way to model this cane end would be to use a rolling, dynamic load which truly models the behavior of a person using the cane. However, for this example, certain conservative assumptions were made. The behavior of the cane end was broken down into its two main components, initial loading close the tip and full loading to failure in the worst-case scenario.

Figure 16:
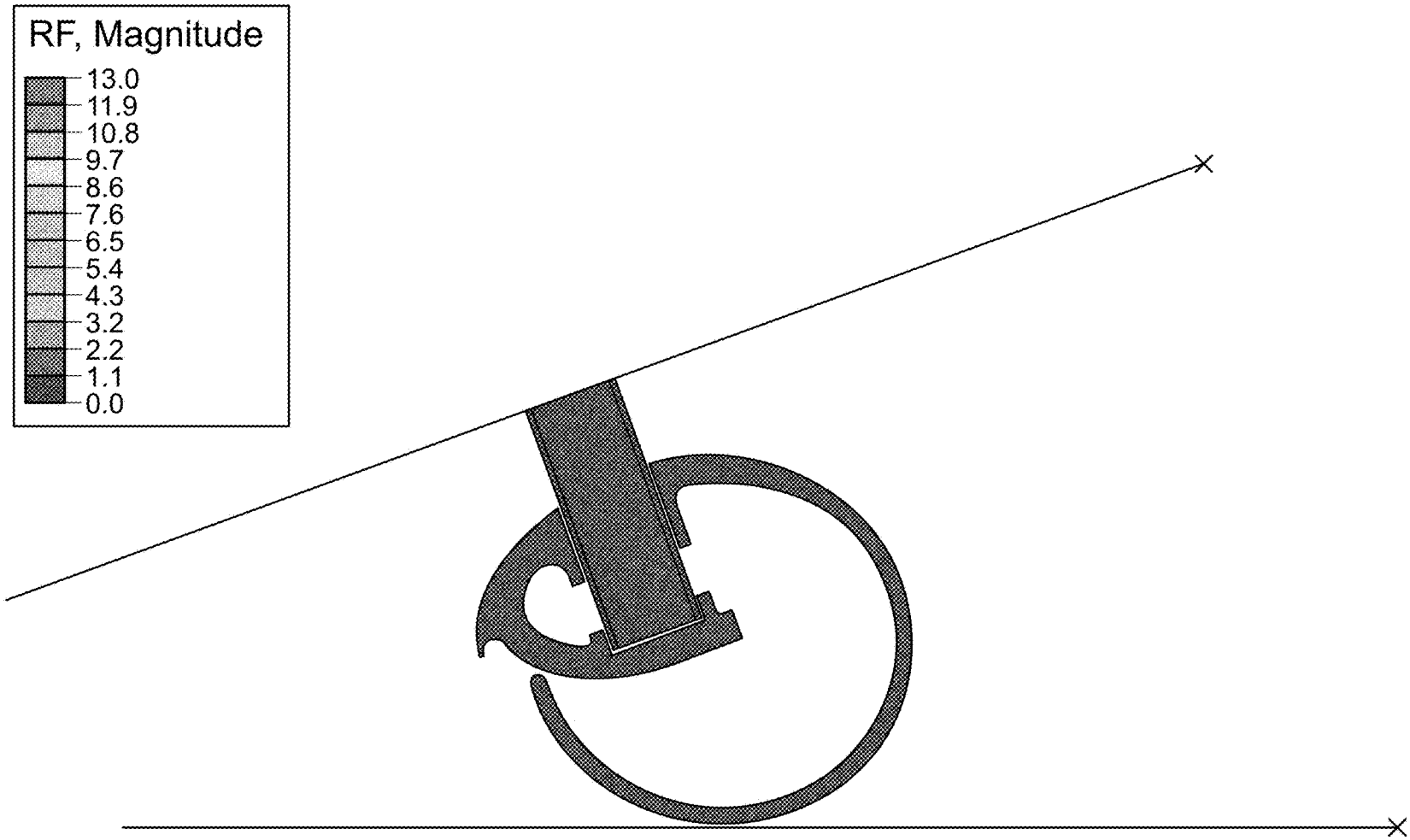
FIG. 16 illustrates can loading and initial point of contact with a surface.

First, looking at the initial loading to determine the amount of force it would take to close the tip of the cane. This would show the initial engagement upon a step and allow for an idea of how much "suspension" the cane is giving. This was done by loading the cane at a 20° angle, as though it were outstretched by a user. An image of the cane loaded in this configuration can be seen in FIG. 16. In FIG. 16, the cane end with the tip at initial contact can be observed. The model is carried out by attaching the cane to a flat surface offset at 20° from another flat surface (modeling the ground). These two surfaces are then pressed together and the reaction forces on the top surface are collected. The magnitude of these forces give the load required to close the cane tip. From this data, it takes approximately 30 pounds to close the cane tip. Ultimately, it is believed that the initial closure load is in a reasonable region.

Next, the ultimate failure load was modeled. This was done in the worst-case scenario, vertical loading. This is where modeling the cane gets quite tricky. Because the contact point with the ground and the point of loading are offset, to create good rolling motion while walking, the mechanics of the cane are very dynamic. This can be seen in the image of FIG. 2B. This moment arm is why the cane wants to roll forward, which is a good thing for the user. It forces good biomechanics and easy use. However, it makes modeling quite difficult. As discussed before, this model would be much more accurate if we modeled it dynamically as though it were being moved by a person. However, for the sake of time and funding, conservative assumptions had to be made. Therefore, the cane was modeled statically by pushing vertically on the cane end until the maximum stress in the part was greater than the yield strength of the material. This point occurred at approximately 140 pounds. The model can be seen in FIG. 3B. Even when the model is loading the cane vertically, it still rolls forward somewhat. This is where the conservative assumptions come into play. At this point, the cane is ~5° offset from vertical. If this were being used by a person, once the cane is no longer at a 0° angle, they will not be exerting maximum load on the cane. Therefore, while we find a failure load of 140 pounds in static modeling, this is a minimum failure load and could likely be higher in real application.

All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

This concludes the description of the example embodiments. Although the present disclosure has been described with reference to a number of illustrative embodiments, it should be understood that numerous other modifications and embodiments can be devised by those skilled in the art that will fall within the spirit and scope of the principles of this disclosure. More particularly, reasonable variations and modifications are possible in the component parts and/or arrangements of the subject combination arrangement within the scope of the foregoing disclosure, the drawings, and the appended claims without departing from the spirit of the disclosure. In addition to variations and modifications in the component parts and/or arrangements, alternative uses will also be apparent to those skilled in the art.

The invention claimed is:

1. A cane end comprising a monolithic body, the monolithic body having an upper portion and a lower portion, wherein the upper and lower portions are continuous, wherein the upper portion comprises at least one engagement member for releasably engaging a shaft of a cane and an optional catch member; and wherein the lower portion comprises a blade having a variable radius of curvature, wherein the cane end has an undeflected conformation which is substantially a mirror image of an "e" shape, wherein the upper portion comprises a top member and a bottom member, wherein the top and bottom members are continuous, wherein the top member comprises a first engagement member, and wherein the bottom member comprises a second engagement member.

2. The cane end of claim 1, wherein the upper portion tapers from a first thickness to a second thickness.

3. The cane end of claim 1, wherein the lower portion has a uniform thickness.

4. The cane end of claim 1, wherein at least a portion of an outer surface of the lower portion comprises one or more traction members.

5. The cane end of claim 1, wherein the cane end deflects under load such that an open end of the lower portion contacts the catch member of the upper portion.

6. The cane end of claim 1, wherein the first and second engagement members are vertically aligned.

7. The cane end of claim 1, wherein a contact point with the ground on the lower portion is offset from a point of vertical loading on the upper portion.

8. A cane end comprising a monolithic body, the monolithic body comprising a lower portion having a continuously convexly curved surface and having a variable radius of curvature; and an upper portion continuous with the lower portion, the upper portion having a continuously curved surface which at least partially extends into a cavity defined by the lower and upper portions, the upper portion further comprising at least one first engagement member for releasably engaging a shaft of a cane, and wherein the lower portion comprises at least one second engagement member for releasably engaging the shaft of the cane, wherein the cane end has an unflexed conformation which is substantially a mirror image of an "e" shape.

9. The cane end of claim 8, wherein the cane end is capable of support a load of at least 30 pounds.

10. The cane end of claim 8, wherein the cane end is constructed from a polymeric material.

11. The cane end of claim 10, wherein at least a portion of an outer surface of the lower portion comprises a material which is different than the material of the lower portion.

* * * * *